US007978044B2

(12) United States Patent
Takeuchi et al.

(10) Patent No.: US 7,978,044 B2
(45) Date of Patent: Jul. 12, 2011

(54) TRANSFORMER

(75) Inventors: Masaki Takeuchi, Tainai (JP); Atsushi Suzuki, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 12/649,381

(22) Filed: Dec. 30, 2009

(65) Prior Publication Data

US 2010/0176906 A1 Jul. 15, 2010

(30) Foreign Application Priority Data

Jan. 9, 2009 (JP) ..... 2009-003638

(51) Int. Cl.
*H01F 27/24* (2006.01)

(52) U.S. Cl. ..... 336/216; 336/212; 336/217; 336/233; 336/234

(58) Field of Classification Search ..... None
See application file for complete search history.

(56) References Cited

U.S. PATENT DOCUMENTS 2,465,798 A * 3/1949 Granfield ..... 336/234
3,172,067 A * 3/1965 Gee ..... 336/217
4,496,925 A * 1/1985 Geschka ..... 336/178
5,959,523 A * 9/1999 Westberg ..... 336/234
2006/0226947 A1 * 10/2006 Pauley et al. ..... 336/234
2007/0033797 A1 * 2/2007 Pauley et al. ..... 29/602.1

FOREIGN PATENT DOCUMENTS

JP 08-250338 9/1996

* cited by examiner

*Primary Examiner* — Anh T Mai
*Assistant Examiner* — Mangtin Lian
(74) *Attorney, Agent, or Firm* — Antonelli, Terry, Stout & Kraus, LLP.

(57) ABSTRACT

A transformer includes a frame type iron core having plate-shaped magnetic members. At least one of the plate-shaped magnetic members has a large width and forms a magnetic circuit in which a magnetic flux is concentrated. Each of the plate-shaped magnetic members includes magnetic member pieces. Each adjacent pair of end surfaces of the magnetic member pieces are joined together to form a joint portion. Three or more joint portions, each of which is formed, by joining together adjacent end surfaces of an adjacent pair of the magnetic member pieces included in the plate-shaped magnetic member having the large width, are shifted from each other in the direction of a magnetic path of the magnetic circuit to increase an effective cross sectional area of the magnetic path. The magnetic member pieces included in the plate-shaped magnetic member having the large width have a high magnetic permeability to reduce a magnetic resistance of the magnetic circuit. This configuration contributes to suppressing an increase in the material cost of the frame type iron core and an increase in the number of processes for manufacturing the frame type iron core and reducing a no-load loss.

7 Claims, 10 Drawing Sheets

CROSS SECTION TAKEN ALONG LINE B-B

CROSS SECTION TAKEN ALONG LINE C - C

MAGNETIC MEMBER PIECES

1021~1023 : MAGNETIC MEMBER PIECES

CROSS SECTION TAKEN ALONG LINE D - D

TRANSFORMER

CLAIM OF PRIORITY

The present application claims priority from Japanese patent application serial No. P2009-003638, filed on Jan. 9, 2009, the content of which is hereby incorporated by reference into this application.

BACKGROUND

The present invention relates to a transformer including a frame type iron core having plate-shaped magnetic members laminated in the order based on the widths of the plate-shaped magnetic members, wherein the magnetic members form respective annular magnetic circuits. The invention more particularly relates to the configuration of the frame type iron core.

According to the amendment of the Law concerning the Rational Use of Energy, the law concerning improvement of characteristics of transformers has come into effect from April, 2006. To comply with the law concerning improvement of characteristics of transformers, it is necessary to reduce loss (no-load loss) that may occur at iron cores included in transformers. In order to reduce a no-load loss of a frame type iron core including laminated plate-shaped magnetic members having different widths, the following measures have been taken so far. In the first one of the measures, magnetic members having excellent magnetic properties are used as the plate-shaped magnetic members forming the frame type iron core. In the second one, joint portions, each of which is formed by joining together end surfaces of the plate-shaped magnetic members, are shifted from each other in the direction of a magnetic path. In the third one, the number of the laminated plate-shaped magnetic members is increased.

SUMMARY

However, any of the first and third measures will lead to an increase in the cost of materials of the frame type iron core. The second measure will also lead to an increase in the number of processes for manufacturing the frame type iron core. Even if any of the aforementioned measures is employed, the manufacturing cost of the frame type iron core and a transformer including the frame type iron core will increase.

In view of the above circumstances, a challenge of the present invention is to reduce the cost of materials of a frame type iron core included in a transformer, and suppress an increase in the number of manufacturing processes, and reduce an iron loss of the frame type iron core and a no-load loss of the transformer.

An object of the present invention is to provide the transformer that includes the frame type iron core and is manufactured at a reduced cost.

The present invention is a technique that solves the aforementioned challenge and achieves the aforementioned object.

Specifically, the transformer according to the present invention includes the frame type iron core having plate-shaped magnetic members that are capable of forming respective annular magnetic circuits and are laminated in the order based on the widths of the plate-shaped magnetic members. At least one of the plate-shaped magnetic members has a large width and forms the magnetic circuit in which a magnetic flux is concentrated. Each adjacent pair of end surfaces of the magnetic member pieces faces each other and is joined together to form a joint portion. Three or more of the joint portions included in the plate-shaped magnetic member having the large width are shifted from each other in the direction of a magnetic path of the magnetic circuit to increase an effective cross sectional area of the magnetic path. The magnetic member pieces included in the plate-shaped magnetic member having the large width have a high magnetic permeability to reduce a magnetic resistance of the magnetic circuit. More specifically, the plate-shaped magnetic member having the largest width among the plate-shaped magnetic members included in the frame type iron core is regarded as a first plate-shaped magnetic member. Each of the plate-shaped magnetic members has corner portions. Three or more of the joint portions, each of which is formed by joining together adjacent end surfaces of an adjacent pair of the magnetic member pieces included in the first plate-shaped magnetic member, are shifted from each other at each of the corner portions of the first plate-shaped magnetic member. The plate-shaped magnetic members other than the first plate-shaped magnetic member are regarded as second plate-shaped magnetic members. Two of the joint portions, each of which is formed by joining together adjacent end surfaces of an adjacent pair of the magnetic member pieces included in each of the second plate-shaped magnetic members, are shifted from each other at each of the corner portions of the second plate-shaped magnetic member. The first plate-shaped magnetic member includes the magnetic member pieces having a relatively high magnetic permeability. Alternatively, the first plate-shaped magnetic member with the largest width includes the magnetic member pieces having a relatively high magnetic permeability, while at least one of the second plate-shaped magnetic members, which has a relatively large width, includes the magnetic member pieces having a relatively high magnetic permeability. Each of the other second magnetic members includes the magnetic member pieces having a relatively low magnetic permeability.

DETAILED DESCRIPTION OF THE PREFERRED EMBODIMENTS

An embodiment of the present invention is described below with reference to the accompanying drawings.

Figure 1B:
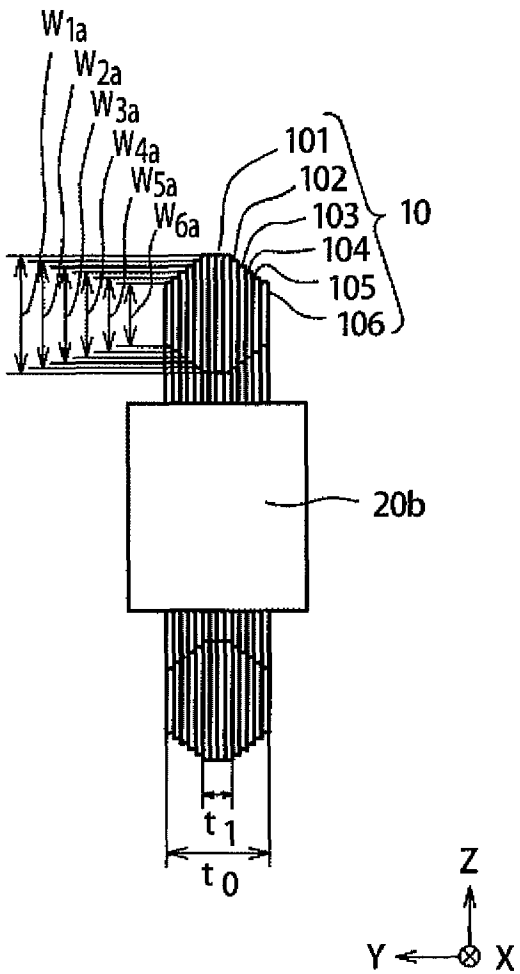
FIGS. 1A and 1B are diagrams each showing the structure of a transformer according to an embodiment of the present invention.
Figure 1A:
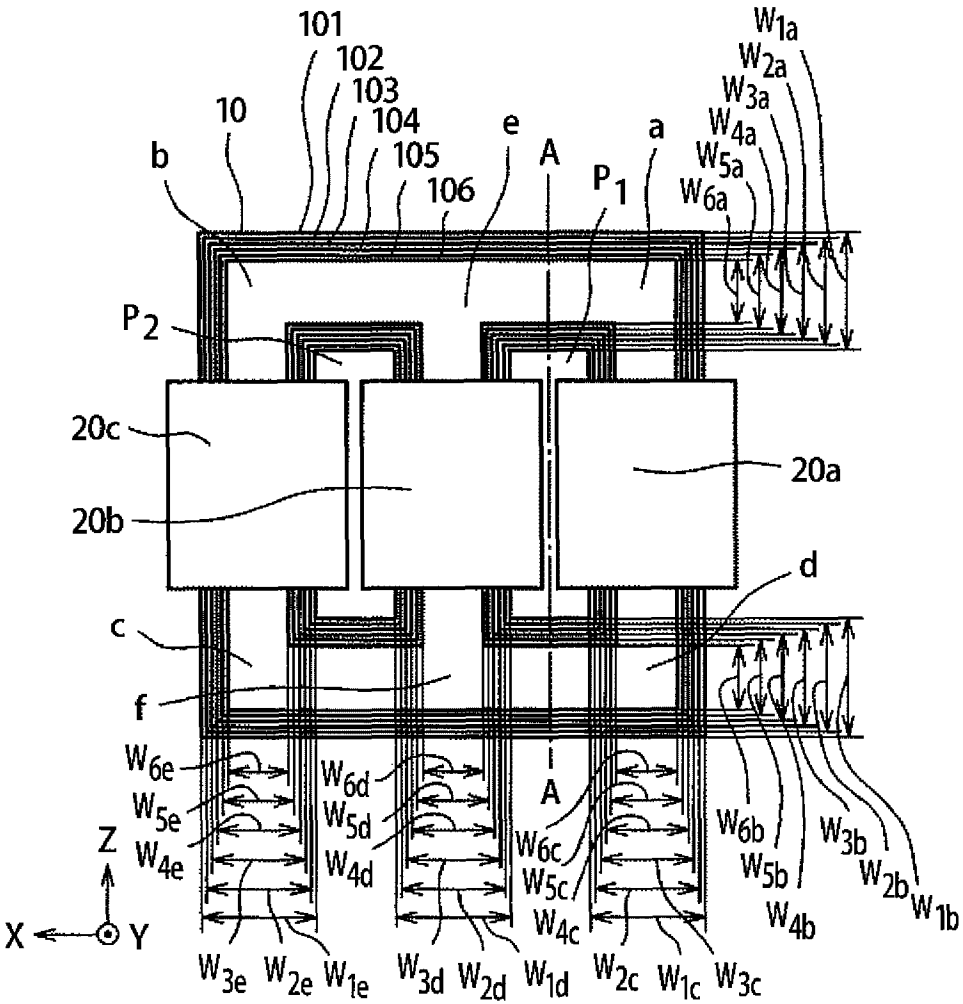
Figure 2A:
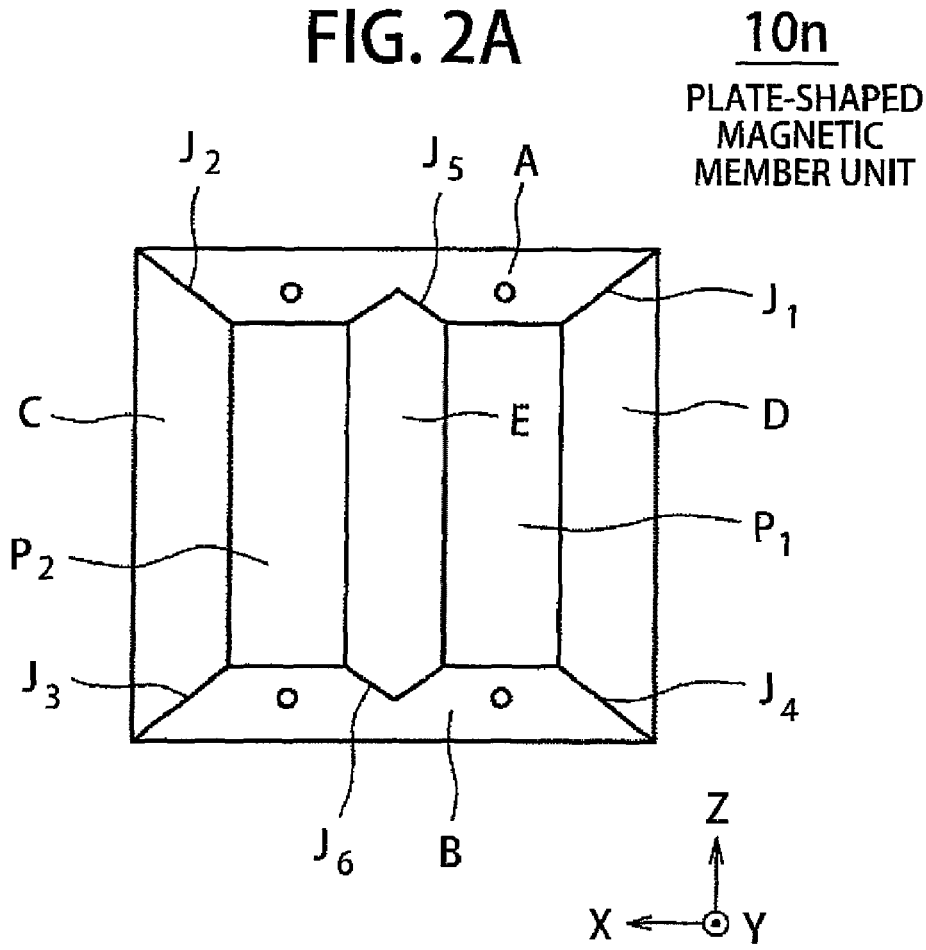
FIGS. 2A and 2B are explanatory diagrams each showing a plate-shaped magnetic member unit that forms a part of a frame type iron core included in the transformer shown in FIGS. 1A and 1B.
Figure 2B:
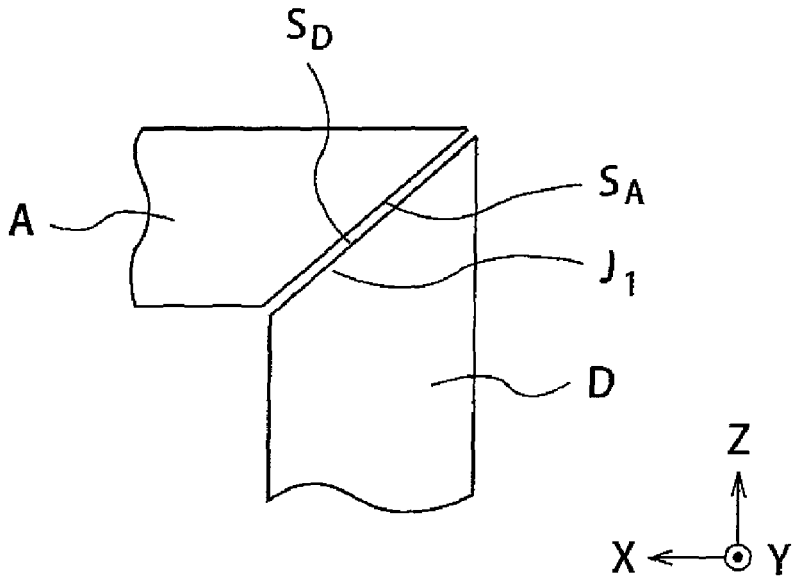
Figure 3:
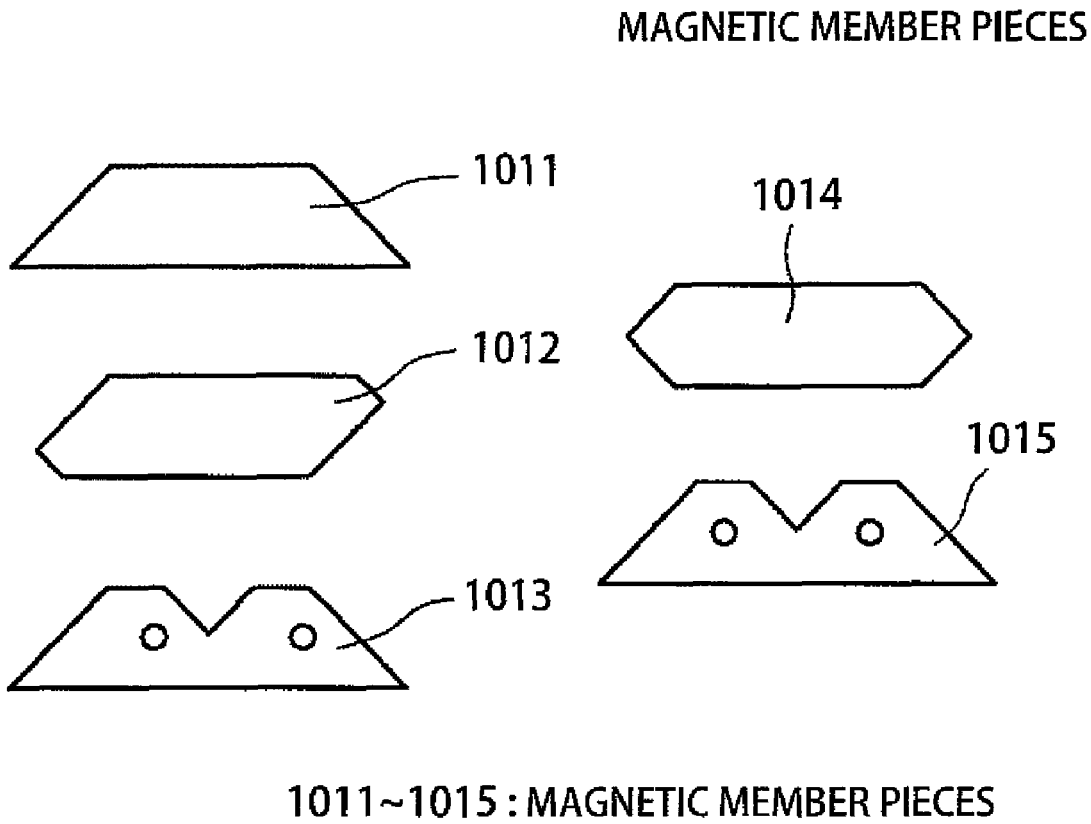
FIG. 3 is a diagram showing magnetic member pieces included in a plate-shaped magnetic member having the largest width among plate-shaped magnetic members that form the frame type iron core included in the transformer shown in FIGS. 1A and 1B.
Figure 4:
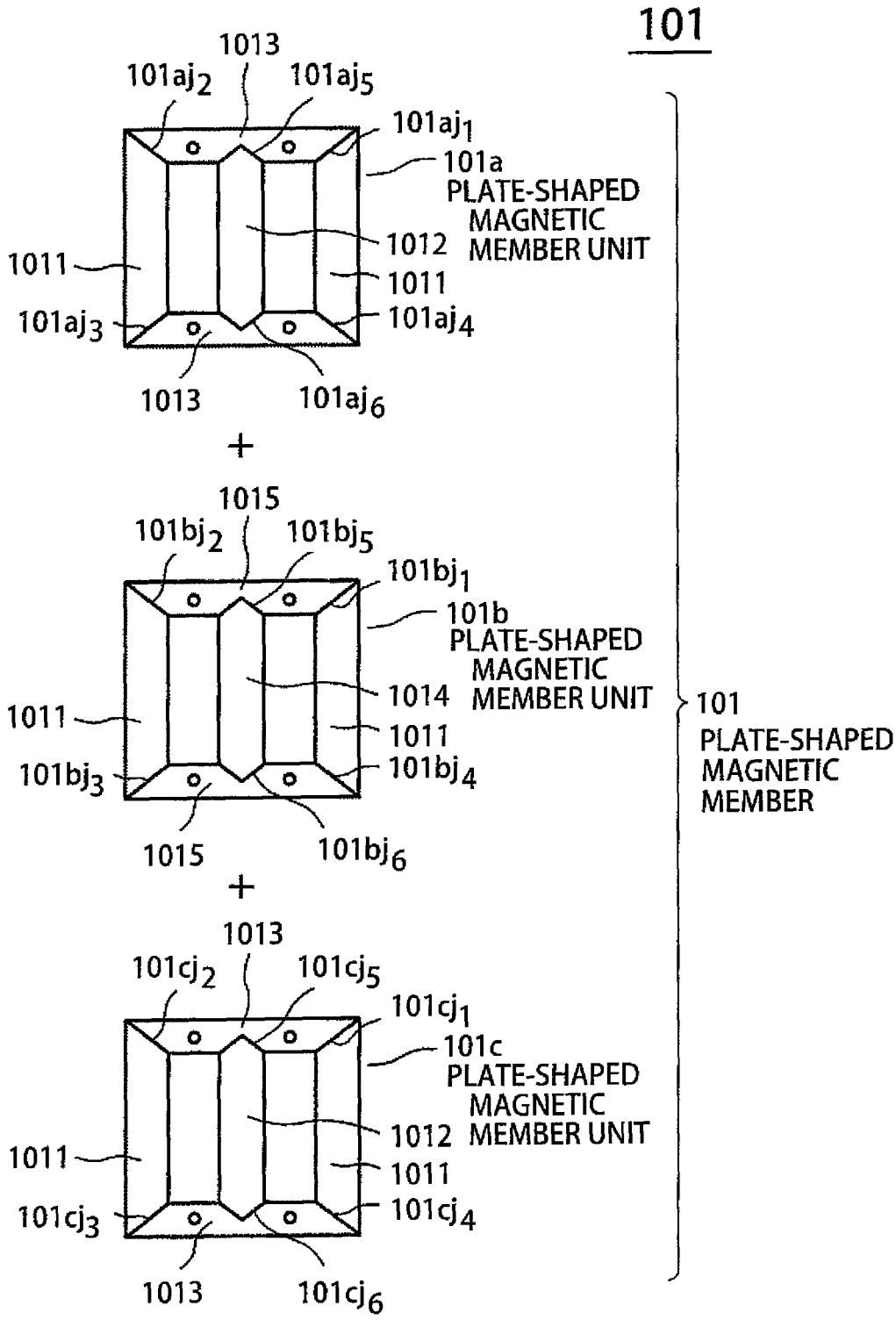
FIG. 4 is an explanatory diagram showing three plate-shaped magnetic member units, each of which has one or more of the magnetic member pieces shown in FIG. 3 on each side of the plate-shaped magnetic member unit.
Figure 5A:
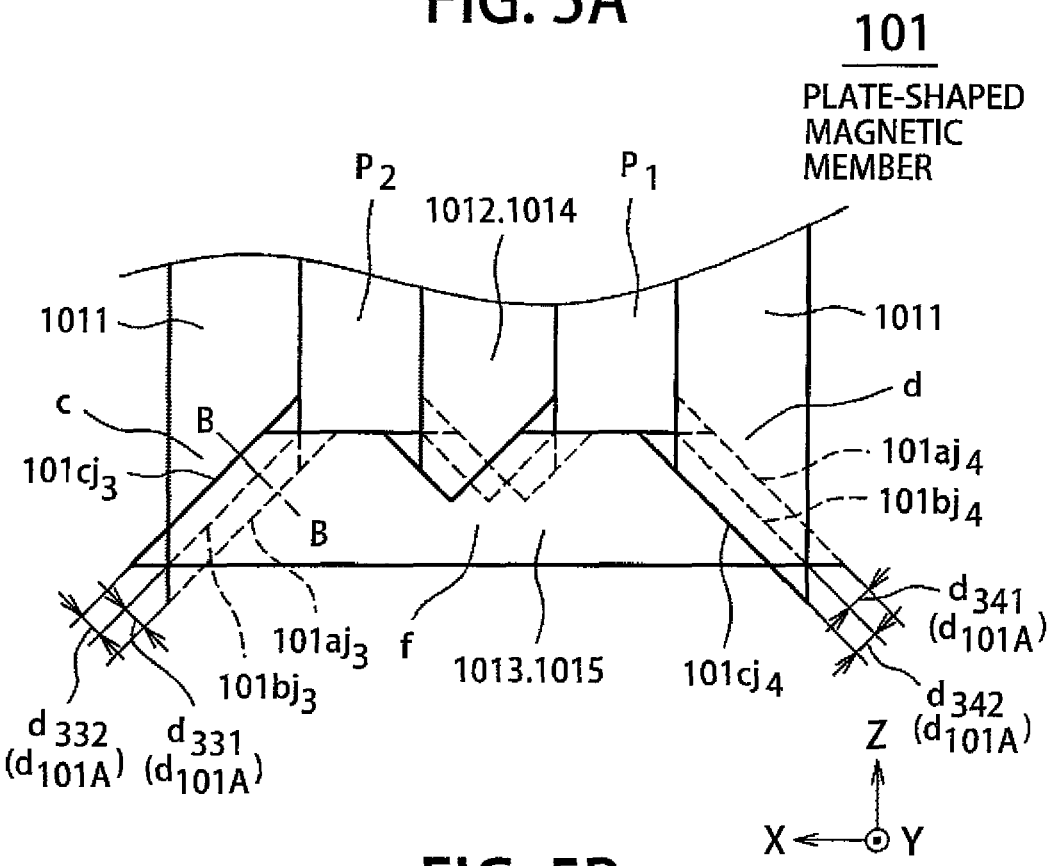
FIGS. 5A and 5B are explanatory diagrams each showing joint portions, each of which is formed by joining together adjacent end surfaces of an adjacent pair of the magnetic member pieces and located at any of corner portions of the plate-shaped magnetic member including the laminated plate-shaped magnetic member units shown in FIG. 4.
Figure 5B:
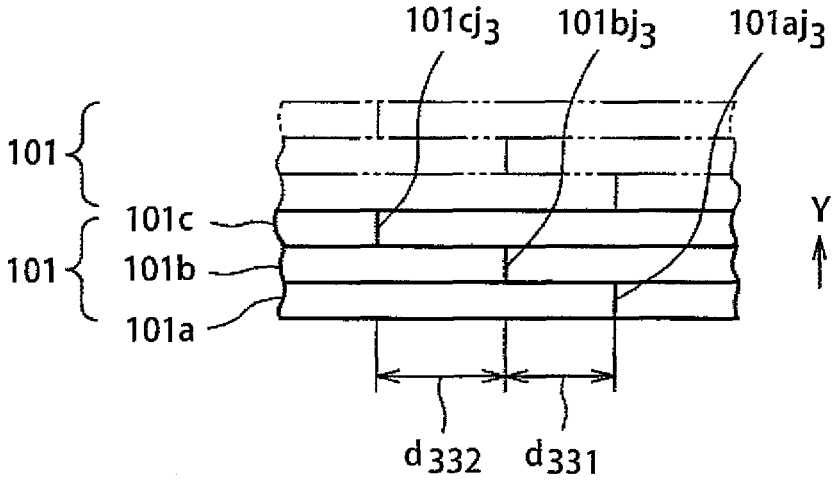
Figure 6:
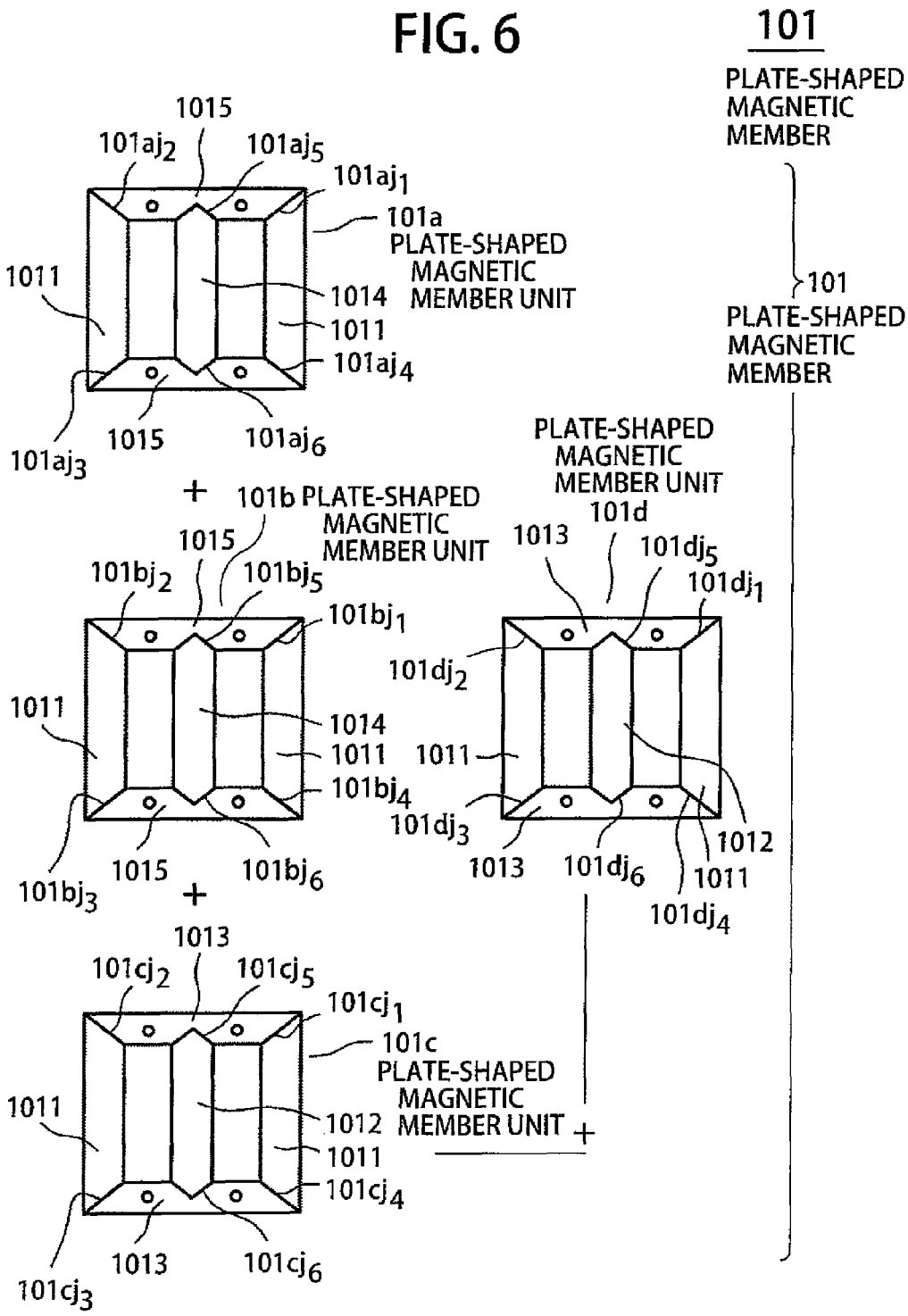
FIG. 6 is an explanatory diagram showing four plate-shaped magnetic member units, each of which has one or more of the magnetic member pieces shown in FIG. 3 on each side of the plate-shaped magnetic member unit.
Figure 7A:
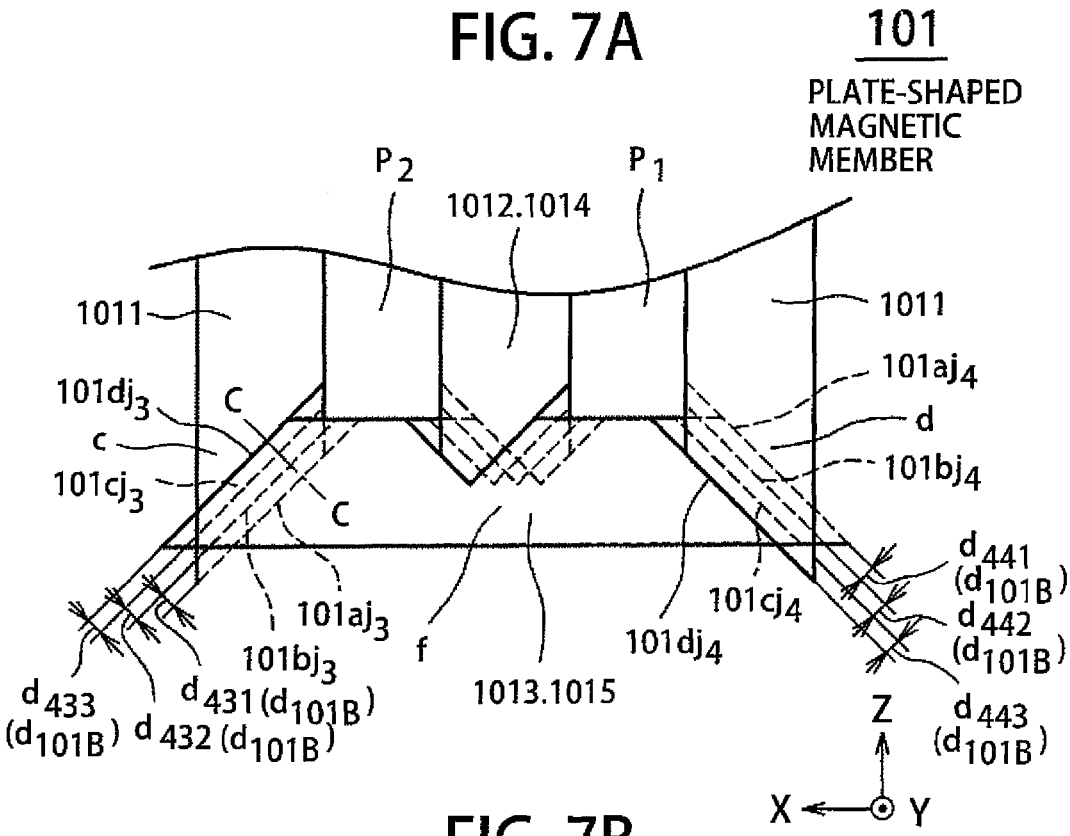
FIGS. 7A and 7B are explanatory diagrams each showing joint portions, each of which is formed by joining together adjacent end surfaces of an adjacent pair of the magnetic member pieces and located at any of corner portions of a plate-shaped magnetic member including the laminated plate-shaped magnetic member units shown in FIG. 6.
Figure 7B:
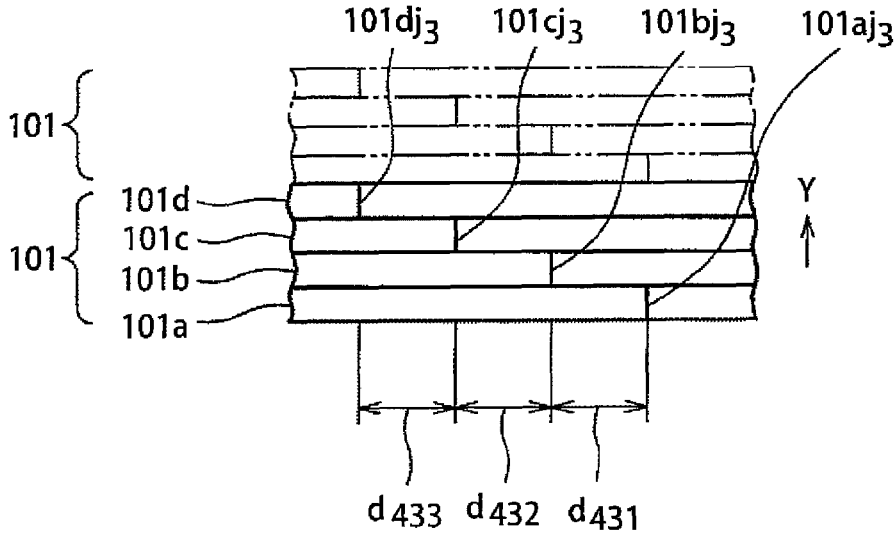
Figure 8:
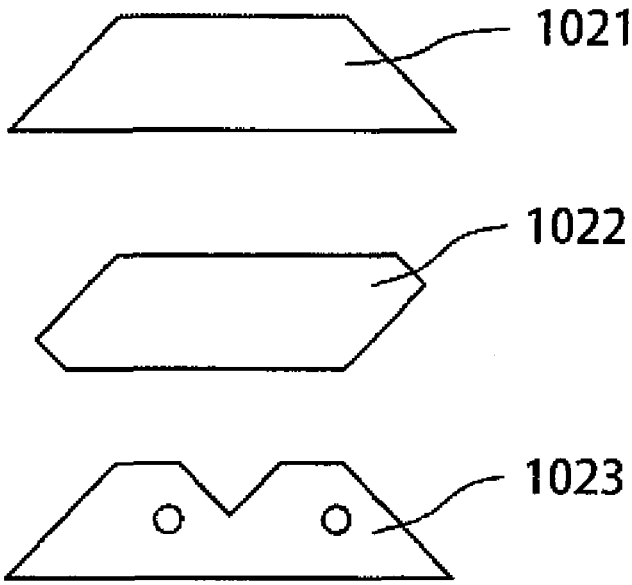
FIG. 8 is a diagram showing magnetic member pieces forming one of the plate-shaped magnetic members (that form a part of the frame type iron core included in the transformer shown in FIGS. 1A and 1B) other than the plate-shaped magnetic member having the largest width.
Figure 9:
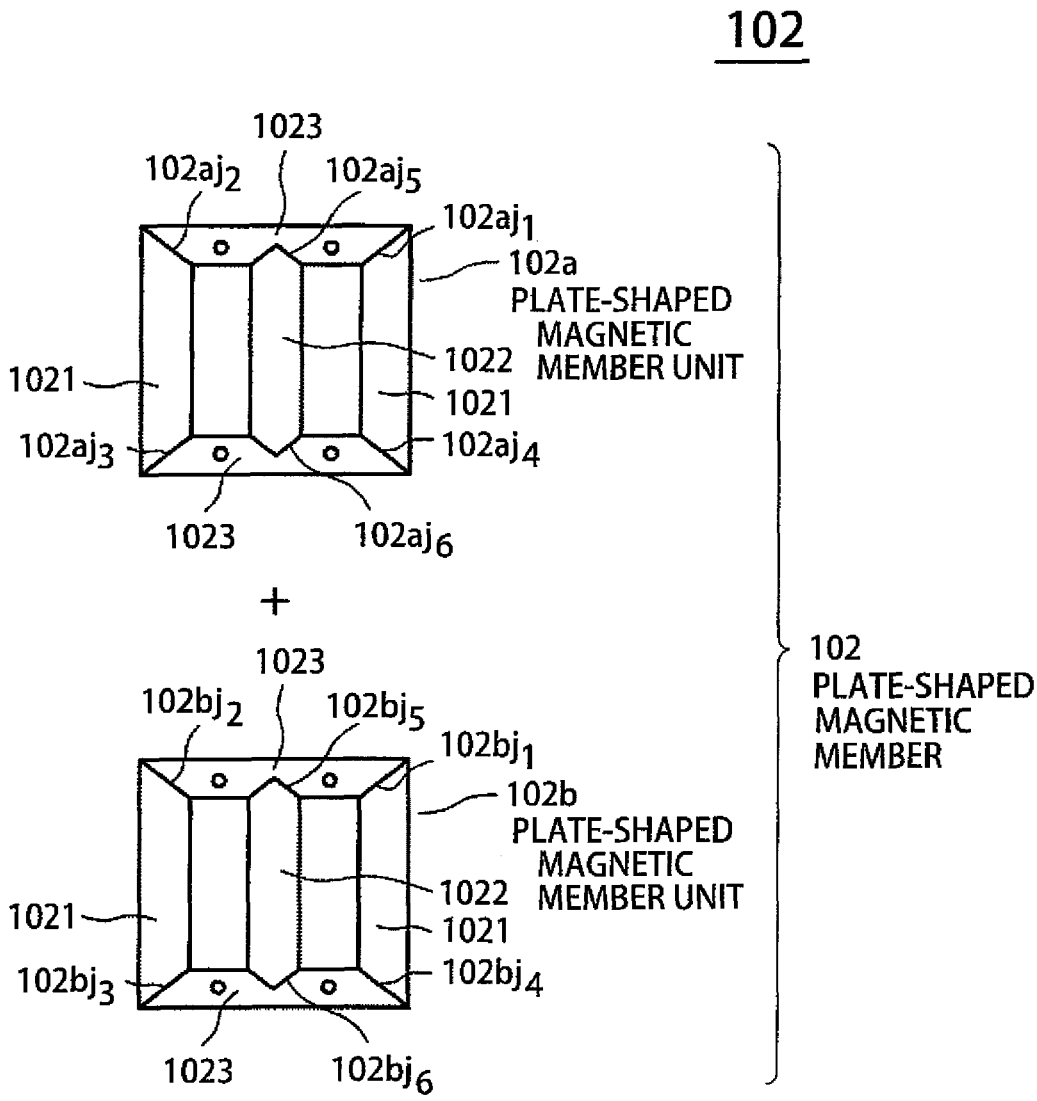
FIG. 9 is an explanatory diagram showing two plate-shaped magnetic member units, each of which has one or more of the magnetic member pieces shown in FIG. 8 on each side of the plate-shaped magnetic member unit.
Figure 10A:
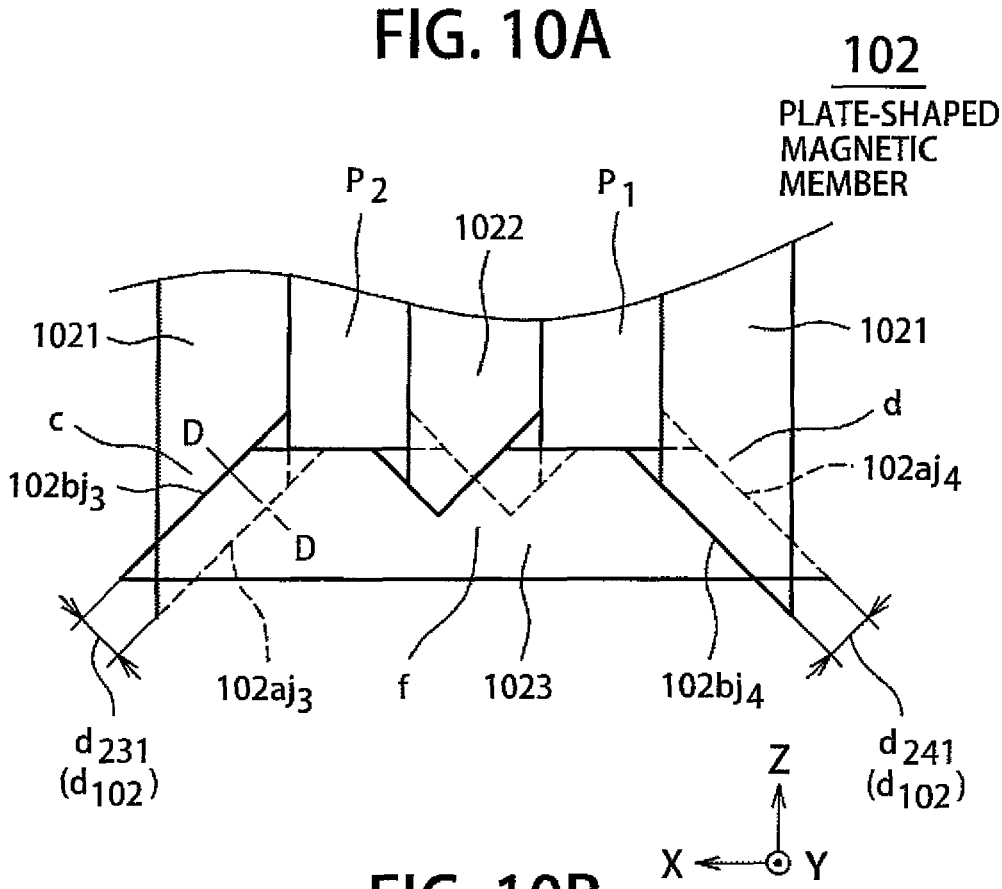
FIGS. 10A and 10B are explanatory diagrams each showing joint portions, each of which is formed by joining together adjacent end surfaces of an adjacent pair of the magnetic member pieces and located at any of corner portions of a plate-shaped magnetic member including the laminated plate-shaped magnetic member units shown in FIG. 9.
Figure 10B:
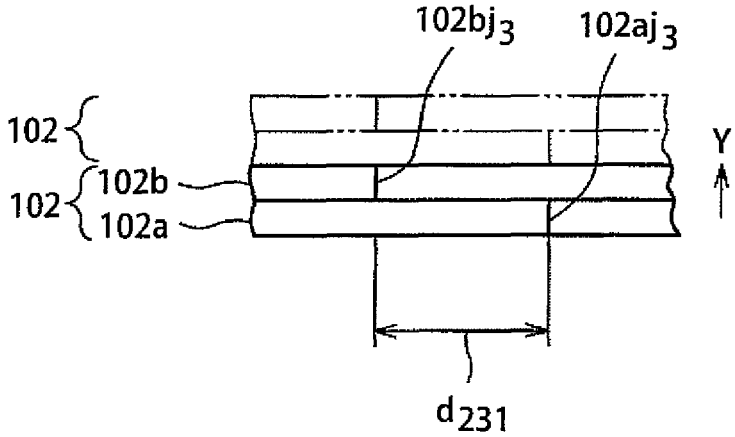

FIGS. 1A and 1B are diagrams each showing a transformer according to the embodiment of the present invention. FIGS. 2A and 2B are explanatory diagrams each showing a plate-shaped magnetic member unit that forms a part of a frame type iron core included in the transformer shown in FIGS. 1A and 1B. FIG. 3 is a diagram showing magnetic member pieces included in a plate-shaped magnetic member having the largest width among plate-shaped magnetic members that form a part of the frame type iron core included in the transformer shown in FIGS. 1A and 1B. FIG. 4 is an explanatory diagram showing three plate-shaped magnetic member units, each of which has one or more of the magnetic member pieces shown in FIG. 3 on each side of the plate-shaped magnetic member unit. FIGS. 5A and 5B are explanatory diagrams each showing joint portions, each of which is formed by joining together adjacent end surfaces of an adjacent pair of the magnetic member pieces and located at any of corner portions of the plate-shaped magnetic member including the laminated plate-shaped magnetic member units shown in FIG. 4. FIG. 6 is an explanatory diagram showing four plate-shaped magnetic member units, each of which has one or more of the magnetic member pieces shown in FIG. 3 on each side of the plate-shaped magnetic member unit. FIGS. 7A and 7B are explanatory diagrams each showing joint portions, each of which is formed by joining together adjacent end surfaces of an adjacent pair of the magnetic member pieces and located at any of corner portions of a plate-shaped magnetic member including the laminated plate-shaped magnetic member units shown in FIG. 6. FIG. 8 is a diagram showing magnetic member pieces forming one of the plate-shaped magnetic members (that form a part of the frame type iron core included in the transformer shown in FIGS. 1A and 1B) other than the plate-shaped magnetic member having the largest width. FIG. 9 is an explanatory diagram showing two plate-shaped magnetic member units, each of which has one or more of the magnetic member pieces shown in FIG. 8 on each side of the plate-shaped magnetic member unit. FIGS. 10A and 10B are explanatory diagrams each showing joint portions, each of which is formed by joining together adjacent end surfaces of an adjacent pair of the magnetic member pieces and located at any of corner portions of a plate-shaped magnetic member including the laminated plate-shaped magnetic member units shown in FIG. 9.

FIG. 1A is a front view of the transformer. FIG. 1B is a cross sectional view of the transformer taken along a line A-A of FIG. 1A.

In FIGS. 1A and 1B, reference numeral 1 denotes the transformer according to the embodiment of the present invention; reference numeral 10 denotes the frame type iron core that has plate-shaped magnetic members laminated in the order based on the widths of the plate-shaped magnetic members and is capable of forming an annular magnetic circuit for the transformer 1; each of reference numerals 20*a*, 20*b*, and 20*c* denote a coil that is wound around the frame type iron core 10 and excites the frame type iron core 10 when electricity is conducted through the coil; and reference numerals 101 to 106 denote the respective plate-shaped magnetic members included in the frame type iron core 10. The frame type iron core 10 includes a plurality of the plate-shaped magnetic members 101, a plurality of the plate-shaped magnetic members 102, a plurality of the plate-shaped magnetic members 103, a plurality of the plate-shaped magnetic members 104, a plurality of the plate-shaped magnetic members 105, and a plurality of the plate-shaped magnetic members 106. Each of the plate-shaped magnetic members 101 (first plate-shaped magnetic members) has the largest width among the plate-shaped magnetic members. Each of the plate-shaped magnetic members 102 (second plate-shaped magnetic members) has a width smaller than those of the plate-shaped magnetic members 101. Each of the plate-shaped magnetic members 103 (second plate-shaped magnetic members) has a width smaller than those of the plate-shaped magnetic members 102. Each of the plate-shaped magnetic members 104 (second plate-shaped magnetic members) has a width smaller than those of the plate-shaped magnetic members 103. Each of the plate shaped magnetic members 105 (second plate-shaped magnetic members) has a width smaller than those of the plate-shaped magnetic members 104. Each of the plate-shaped magnetic members 106 (second plate-shaped magnetic members) has a width smaller than those of the plate-shaped magnetic members 105. The plate-shaped magnetic members 101, 102, 103, 104, 105, and 106 are arranged in this order in a ±Y direction shown in FIGS. 1A and 1B. In FIGS. 1A and 1B, symbols $W_{1a}$ and $W_{1b}$ denote respective widths of each of the first plate-shaped magnetic members 101. The widths $W_{1a}$ and $W_{1b}$ of each of the first plate-shaped magnetic members 101 are measured in a ±Z direction shown in FIGS. 1A and 1B. Symbols $W_{2a}$ and $W_{2b}$ denote respective widths of each of the second plate-shaped magnetic members 102. The widths $W_{2a}$ and $W_{2b}$ of each of the second plate-shaped magnetic members 102 are measured in the ±Z direction shown in FIGS. 1A and 1B. Symbols $W_{3a}$ and $W_{3b}$ denote respective widths of each of the second plate-shaped magnetic members 103. The widths $W_{3a}$ and $W_{3b}$ of each of the second plate-shaped magnetic members 103 are measured in the ±Z direction shown in FIGS. 1A and 1B. Symbols $W_{4a}$ and $W_{4b}$ denote respective widths of each of the second plate-shaped magnetic members 104. The widths $W_{4a}$ and $W_{4b}$ of each of the second plate-shaped magnetic members 104 are measured in the ±Z direction shown in FIGS. 1A and 1B. Symbols $W_{5a}$ and $W_{5b}$ denote respective widths of each of the second plate-shaped magnetic members 105. The widths $W_{5a}$ and $W_{5b}$ of each of the second plate-shaped magnetic members 105 are measured in the ±Z direction shown in FIGS. 1A and 1B. Symbols $W_{6a}$ and $W_{6b}$ denote respective widths of each of the second plate-shaped magnetic members 106. The widths $W_{6a}$ and $W_{6b}$ of each of the second plate-shaped magnetic members 106 are measured in the ±Z direction shown in FIGS. 1A and 1B. Symbols $W_{1c}$, $W_{1d}$, and $W_{1e}$ denote respective widths of each of the first plate-shaped magnetic members 101. The widths $W_{1c}$. $W_{1d}$, and $W_{1e}$ of each of the first plate-shaped magnetic members 101 are measured in the ±Y direction shown in FIGS. 1A and 1B. Symbols $W_{2c}$, $W_{2d}$, and $W_{2e}$ denote respective widths of each of the second plate-shaped magnetic members 102. The widths $W_{2c}$, $W_{2d}$, and $W_{2e}$ of each of the second plate-shaped magnetic members 102 are measured in the ±Y direction shown in FIGS. 1A and 1B. Symbols $W_{3c}$, $W_{3d}$, and $W_{3e}$, denote respective widths of each of the second plate-shaped magnetic members 103. The widths $W_{3c}$, $W_{3d}$, and $W_{3e}$ of each of the second plate-shaped magnetic members 103 are measured in the ±Y direction shown in FIGS. 1A and 1B. Symbols $W_{4c}$, $W_{4d}$, and $W_{4e}$ denote respective widths of each of the second plate-shaped magnetic members 104. The widths $W_{4c}$, $W_{4d}$, and $W_{4e}$ of each of the second plate-shaped magnetic members 104 are measured in the ±Y direction shown in FIGS. 1A and 1B. Symbols $W_{5c}$, $W_{5d}$, and $W_{5e}$ denote respective widths of each of the second plate-shaped magnetic members 105. The widths $W_{5c}$, $W_{5d}$, and $W_{5e}$ of each of the second plate-shaped magnetic members 105 are measured in the ±Y direction shown in FIGS. 1A and 1B. Symbols $W_{6c}$, $W_{6d}$, and $W_{6e}$ denote respective widths of each of the second plate-shaped magnetic members 106. The widths $W_{6c}$, $W_{6d}$, and $W_{6e}$ of each of the second plate-shaped magnetic members 106 are measured in the ±Y direction shown in FIGS. 1A and 1B. In FIG. 1B, symbol $t_1$ denotes the total thickness of the first plate-shaped magnetic members 101. The total thickness $t_1$ of the first plate-shaped magnetic members 101 is measured in the ±Y direction. Symbol $t_0$ denotes the total thickness of the plate-shaped magnetic members 101 to 106. The total thickness $t_0$ of the plate-shaped magnetic members 101 to 106 is measured in the ±Y direction. Each of the plate-shaped magnetic members 101 to 106 has openings formed in its flat surface. In FIG. 1A, symbols $P_1$ and $P_2$ denote the respective openings of each of the plate-shaped magnetic members 101 to 106. In FIG. 1A, symbols a, b, c, d, e, and f denote respective corner portions of each of the plate-shaped magnetic members 101 to 106. Each of the first and second plate-shaped magnetic members 101 to 106 has first and second inner circumferences that define the respective openings $P_1$ and $P_2$. The length of the first inner circumference of each of the first plate-shaped magnetic members 101 is the smallest among those of the first inner circumferences of the plate-shaped magnetic members 101 to 106. In addition, the length of the second inner circumference of each of the first plate-shaped magnetic member 101 is the smallest among those of the second inner circumferences of the plate-shaped magnetic members 101 to 106. Each of the first and second plate-shaped magnetic members 101 to 106 has an outer circumference. The length of the outer circumference of each of the first plate-shaped magnetic members 101 is the largest among those of the outer circumferences of the plate-shaped magnetic members 101 to 106. The length of the first inner circumference of each of the second plate-shaped magnetic members 102 is smaller than those of the first inner circumferences of the second plate-shaped magnetic members 103. The length of the second inner circumference of each of the second plate-shaped magnetic members 102 is smaller than those of the second inner circumferences of the second plate-shaped magnetic members 103. The length of the first inner circumference of each of the second plate-shaped magnetic members 103 is smaller than those of the first inner circumferences of the second plate-shaped magnetic members 104. The length of the second inner circumference of each of the second plate-shaped magnetic members 103 is smaller than those of the second inner circumferences of the second plate-shaped magnetic members 104. The length of the first inner circumference of each of the second plate-shaped magnetic members 104 is smaller than those of the first inner circumferences of the second plate-shaped magnetic members 105. The length of the second inner circumference of each of the second plate-shaped magnetic members 104 is smaller than those of the second inner circumferences of the second plate-shaped magnetic members 105. The length of the first inner circumference of each of the second plate-shaped magnetic members 105 is smaller than those of the first inner circumferences of the second plate-shaped magnetic members 106. The length of the second inner circumference of each of the second plate-shaped magnetic members 105 is smaller than those of the second inner circumferences of the second plate-shaped magnetic members 106. The length of the outer circumference of each of the second plate-shaped magnetic members 102 is larger than those of the outer circumferences of the second plate-shaped magnetic members 103. The length of the outer circumference of each of the second plate-shaped magnetic members 103 is larger than those of the outer circumferences of the second plate-shaped magnetic members 104. The length of the outer circumference of each of the second plate-shaped magnetic members 104 is larger than those of the outer circumferences of the second plate-shaped magnetic members 105. The length of the outer circumference of each of the second plate-shaped magnetic members 105 is larger than those of the outer circumferences of the second plate shaped magnetic members 106. The plate-shaped magnetic members 101 to 106 are capable of forming respective annular magnetic circuits. Thus, the frame type iron core 10 is capable of forming the annular magnetic circuit.

Each of the plate-shaped magnetic members 101 to 106 has at least one magnetic member piece on each side thereof. The plate-shaped magnetic members 101 to 106 are laminated under the condition that: three or four of the joint portions, each of which is formed by joining together adjacent pair of the end surfaces (facing each other) of an adjacent pair of the magnetic member pieces that form the respective sides of each first plate-shaped magnetic member 101, are shifted from each other at each of the corner portions a, b, c, d, e, and f of the first plate-shaped magnetic member 101; and two of the joint portions, each of which is formed by joining together an adjacent pair of the end surfaces (facing each other) of an adjacent pair of the magnetic member pieces that form the respective sides of each of the second plate-shaped magnetic members 102 to 106, area shifted from each other at each of the corner portions a, b, c, d, e, and f of the second plate-shaped magnetic member. In other words, each of the plate-shaped magnetic members 101 to 106 has at least one of the magnetic member pieces on each side thereof. Each adjacent pair of the end surfaces of the adjacent pairs of the magnetic member pieces faces each other and is joined together at any of the corner portions a to f of each of the plate-shaped magnetic members 101 to 106. The joint portions, which are included in the respective plate-shaped magnetic member units included in each of the plate-shaped magnetic members 101 to 106, are shifted from each other at each of the corner portions a, b, c, d, e, and f of each of the plate-shaped magnetic members 101 to 106. The plate-shaped magnetic member units are the minimum units of each plate-shaped magnetic member (that is formed by joining the magnetic member pieces and has one or more of the magnetic member pieces on each side of the plate-shaped magnetic member). The joint portions included in each of the plate-shaped magnetic members 101 to 106 are shifted from each other at each corner portion of the plate-shaped magnetic member in the direction of the magnetic path of the magnetic circuit formed by the plate-shaped magnetic member. Each of the first plate-shaped magnetic members 101 includes the three plate-shaped magnetic member units shown in FIG. 4 or includes the four plate-shaped magnetic member units shown in FIG. 6. When each of the first plate-shaped magnetic members 101 includes the three plate-shaped magnetic member units shown in FIG. 4, the three joint portions of the respective three plate-shaped magnetic member units are shifted from each other at each of the corner portions of the first plate-shaped magnetic member 101. When each of the first plate-shaped magnetic members 101 includes the four plate-shaped magnetic member units shown in FIG. 6, the four joint portions of the respective four plate-shaped magnetic member units are shifted from each other at each of the corner portions of the first plate-shaped magnetic member 101. Each of the second plate-shaped magnetic members 102 to 106 includes the two plate-shaped magnetic member units shown in FIG. 9. The two joint portions of the respective two plate-shaped magnetic member units are shifted from each other at each of the corner portions of each of the second plate-shaped magnetic members 102 to 106. Each of the first plate-shaped magnetic members 101 includes the three or four plate-shaped magnetic member units (for the first plate-shaped magnetic members 101). Each of the second plate-shaped magnetic members 102 includes the two plate-shaped magnetic member units (for the second plate-shaped magnetic members 102). Each of the second plate-shaped magnetic members 103 includes the two plate-shaped magnetic member units (for the second plate-shaped magnetic members 103). Each of the second plate-shaped magnetic members 104 includes the two plate-shaped magnetic member units (for the second plate-shaped magnetic members 104). Each of the second plate-shaped magnetic members 105 includes the two plate-shaped magnetic member units (for the second plate-shaped magnetic members 105). Each of the second plate-shaped magnetic members 106 includes the two plate-shaped magnetic member units (for the second plate-shaped magnetic members 106). Each of the plate-shaped magnetic member units for the first plate-shaped magnetic members 101 has one or two of the magnetic member pieces on each side thereof (or on each of any adjacent two of the sides of the plate-shaped magnetic member units for the first plate-shaped magnetic members 101). Each of the plate-shaped magnetic member units for the second plate-shaped magnetic members 102 has one of the magnetic member pieces on each side thereof (or on each of any adjacent two of the sides of the plate-shaped magnetic member units for the second plate-shaped magnetic members 102) or has three or more of the magnetic member pieces on each side thereof (or on each of any adjacent two of the sides of the plate-shaped magnetic member units for the second plate-shaped magnetic members 102). Each of the plate-shaped magnetic member units for the second plate-shaped magnetic members 103 has one of the magnetic member pieces on each side thereof (or on each of any adjacent two of the sides of the plate-shaped magnetic member units for the second plate-shaped magnetic members 103) or has three or more of the magnetic member pieces on each side thereof (or on each of any adjacent two of the sides of the plate-shaped magnetic member units for the second plate-shaped magnetic members 103). Each of the plate-shaped magnetic member units for the second plate-shaped magnetic members 104 has one of the magnetic member pieces on each side thereof (or on each of any adjacent two of the sides of the plate-shaped magnetic member units for the second plate-shaped magnetic members 104) or has three or more of the magnetic member pieces on each side thereof (or on each of any adjacent two of the sides of the plate-shaped magnetic member units for the second plate-shaped magnetic members 104). Each of the plate-shaped magnetic member units for the second plate-shaped magnetic members 105 has one of the magnetic member pieces on each side thereof (or on each of any adjacent two of the sides of, the plate-shaped magnetic member units for the second plate-shaped magnetic members 105) or has three or more of the magnetic member pieces on each side thereof (or on each of any adjacent two of the sides of the plate-shaped magnetic member units for the second plate-shaped magnetic members 105). Each of the plate-shaped magnetic member units for the second plate-shaped magnetic members 106 has one of the magnetic member pieces on each side thereof (or on each of any adjacent two of the sides of the plate-shaped magnetic member units for the second plate-shaped magnetic members 106) or has three or more of the magnetic member pieces on each side thereof (or on each of any adjacent two of the sides of the plate-shaped magnetic member units for the second plate-shaped magnetic members 106). As described above, the symbol $t_1$ indicates the total thickness of the plurality of first plate-shaped magnetic members 101, and the symbol $t_0$ indicates the sum of the total thickness $t_1$ of the plurality of first plate-shaped magnetic members 101, the total thickness of the plurality of second plate-shaped magnetic members 102, the total thickness of the plurality of second plate-shaped magnetic members 103, the total thickness of the plurality of second plate-shaped magnetic members 104, the total thickness of the plurality of second plate-shaped magnetic members 105, and the total thickness of the plurality of second plate-shaped magnetic members 106. The total thickness $t_1$ of the plurality of first plate-shaped magnetic members 101 is larger than the total thickness of the plurality of second plate-shaped magnetic members 102. The total thickness $t_1$ of the plurality of first plate-shaped magnetic members 101 is larger than the total thickness of the plurality of second plate-shaped magnetic members 103. The total thickness $t_1$ of the plurality of first plate-shaped magnetic members 101 is larger than the total thickness of the plurality of second plate-shaped magnetic members 104. The total thickness $t_1$ of the plurality of first plate-shaped magnetic members 101 is larger than the total thickness of the plurality of second plate-shaped magnetic members 105. The total thickness $t_1$ of the plurality of first plate-shaped magnetic members 101 is larger than the total thickness of the plurality of second plate-shaped magnetic members 106.

When electricity is conducted through the coils 20*a*, 20*b*, and 20*c* to excite the frame type iron core 10, a magnetic flux is generated in the frame type iron core 10. In this case, since a magnetic resistance of the magnetic circuit formed in the vicinity of the inner circumferences (that define the respective openings $P_1$ and $P_2$) of each first plate-shaped magnetic member 101 is the lowest, the magnetic flux is concentrated in the magnetic circuit (formed in the vicinity of the inner circumferences of each first plate-shaped magnetic member 101) at the highest rate. The total thickness $t_1$ of the first plate-shaped magnetic members 101 is set to a value (e.g., approximately $100\times10^{-3}$ m) sufficient to prevent the magnetic resistance of the magnetic circuit formed in the vicinity of the inner circumferences of each first plate-shaped magnetic member 101 from increasing due to an effect (e.g., magnetic saturation) caused by an increase in the density of the magnetic flux even when the magnetic flux is concentrated. Thus, a sufficient cross sectional area of the magnetic path is ensured. Each of the first plate-shaped magnetic members 101 includes the magnetic member pieces having a higher magnetic permeability than the magnetic member pieces included in the second plate-shaped magnetic members 102 to 106 in order to suppress an increase in the magnetic resistance of the magnetic circuit in which the magnetic flux is concentrated. The total thickness ($t_0-t_1$) of the second plate-shaped magnetic members 102 to 106 is approximately $100\times10^{-3}$ m, for example. The total thickness $t_0$ of the first and second plate-shaped magnetic members 101 to 106 is approximately $200\times10^{-3}$ m.

Parts and elements that are described below and similar or the same as those shown in FIGS. 1A and 1B are denoted by the same reference numerals shown in FIGS. 1A and 1B.

FIGS. 2A and 2B are the explanatory diagrams each showing the plate-shaped magnetic member unit forming the part of the frame type iron core 10 included in the transformer 1 shown in FIGS. 1A and 1B. FIG. 2A is a front view of the plate-shaped magnetic member unit. FIG. 2B shows the joint portion formed by joining together adjacent two of the magnetic member pieces and located at a corner portion of the plate-shaped magnetic member unit.

In FIGS. 2A and 2B, reference numeral 10*n* denotes the plate-shaped magnetic member unit; symbols A, B, C, D, and E denote the respective magnetic member pieces; symbol $J_1$ denotes a joint portion formed by joining together end surfaces (facing each other) of the magnetic member pieces A and D adjacent to each other; symbol $J_2$ denotes a joint portion formed by joining together end surfaces (facing each other) of the magnetic member pieces A and C adjacent to each other; symbol $J_3$ denotes a joint portion formed by joining together end surfaces (facing each other) of the magnetic member pieces B and C adjacent to each other; symbol $J_4$ denotes a joint portion formed by joining together end surfaces (facing each other) of the magnetic member pieces B and D adjacent to each other; symbol $J_5$ denotes a joint portion formed by joining together end surfaces (facing each other) of the magnetic member pieces A and E adjacent to each other; symbol $J_6$ denotes a joint portion formed by joining together end surfaces (facing each other) of the magnetic member pieces B and E adjacent to each other; symbol $S_A$ denotes the end surface of the magnetic member piece A; and symbol $S_D$ denotes the end surface of the magnetic member piece D. The end surfaces $S_A$ and $S_D$ are joined together to form the joint portion $J_1$. Adjacent pairs of the other end surfaces of the magnetic member pieces included in the plate-shaped magnetic member unit 10*n* are joined together to form the respective joint portions $J_2$ to $J_6$. Although the end surfaces $S_A$ and $S_D$ are separated from each other in FIG. 2B for convenience, all the adjacent pairs of the end surfaces of the magnetic member pieces actually adhere to each other and are joined together according to the present invention.

FIG. 3 is the diagram showing the magnetic member pieces included in each of the first plate-shaped magnetic members 101 (that have the largest width among the plate-shaped magnetic members 101 to 106 and form a part of the frame type iron core 10 included in the transformer 1 shown in FIGS. 1A and 1B).

In FIG. 3, reference numerals 1011 to 1015 denote the respective magnetic member pieces. Each of the magnetic member pieces 1011 to 1015 forms any of the sides of each of the first plate-shaped magnetic members 101. The magnetic member pieces 1011 to 1015 are formed by pressing respective high-orientation magnetic steel sheets having a thickness of, for example, $0.23\times10^{-3}$ m. The high-orientation magnetic steel sheets have a higher magnetic permeability than general magnetic steel sheets. The frame type iron core 10 includes the laminated first plate-shaped magnetic members 101. Each of the first plate-shaped magnetic members 101 includes the three or four plate-shaped magnetic member units laminated. Each of the plate-shaped magnetic member units has appropriate one or two of the magnetic member pieces 1011 to 1015 on each side thereof.

Parts that are described below and similar or the same as those shown in FIG. 3 are denoted by the same reference numerals shown in FIG. 3.

FIG. 4 is the explanatory diagram showing the three plate-shaped magnetic member units, each of which has one or more of the magnetic member pieces 1011 to 1015 shown in FIG. 3 on each side thereof.

In FIG. 4, reference numerals 101*a*, 101*b*, and 101*c* denote the respective plate-shaped magnetic member units. Reference numerals 101$aj_1$ to 101$aj_4$ denote respective joint portions, each of which is formed by joining together adjacent end surfaces of an adjacent pair of the magnetic member pieces 1011 and 1013 included in the plate-shaped magnetic member unit 101*a*. Reference numerals 101$aj_5$ and 101$aj_6$ denote respective joint portions, each of which is formed by joining together adjacent end surfaces of an adjacent pair of the magnetic member pieces 1013 and 1012 included in the plate-shaped magnetic member unit 101*a*. Reference numerals 101$bj_1$ to 101$bj_4$ denote respective joint portions, each of which is formed by joining together adjacent end surfaces of an adjacent pair of the magnetic member pieces 1011 and 1015 included in the plate-shaped magnetic member unit 101*b*. Reference numerals 101$bj_5$ and 101$bj_6$ denote respective joint portions, each of which is formed by joining together adjacent end surfaces of an adjacent pair of the magnetic member pieces 1014 and 1015 included in the plate-shaped magnetic member unit 101*b*. Reference numerals 101$cj_1$ to 101$cj_4$ denote respective joint portions, each of which is formed by joining together adjacent end surfaces of an adjacent pair of the magnetic member pieces 1011 and 1013 included in the plate-shaped magnetic member unit 101*c*. Reference numerals 101$cj_5$ and 101$cj_6$ denote respective joint portions, each of which is formed by joining together adjacent end surfaces of an adjacent pair of the magnetic member pieces 1013 and 1012 included in the plate-shaped magnetic member unit 101*c*.

As shown in FIG. 5A, the joint portions 101$aj_3$, 101$bj_3$, and 101$cj_3$ are shifted from each other at the corner portion c of each plate-shaped magnetic member 101 in the direction of the magnetic path under the condition that the plate-shaped magnetic member units 101*a*, 101*b*, and 101*c* are laminated to form the first plate-shaped magnetic member 101. In addition, the joint portions 101$aj_4$, 101$bj_4$, and 101$cj_4$ are shifted from each other at the corner portion d of each plate-shaped magnetic member 101 in the direction of the magnetic path under the condition that the plate-shaped magnetic member units 101*a*, 101*b*, and 101*c* are laminated to form the first plate-shaped magnetic member 101. Furthermore, the joint portions 101$aj_1$, 101$bj_1$, and 101$cj_1$ are shifted from each other at the corner portion a of each plate-shaped magnetic member 101 in the direction of the magnetic path under the condition that the plate-shaped magnetic member units 101*a*, 101*b*, and 101*c* are laminated to form the first plate-shaped magnetic member 101. The joint portions 101$aj_2$, 101$bj_2$, and 101$cj_2$ are shifted from each other at the corner portion b of each plate-shaped magnetic member 101 in the direction of the magnetic path under the condition that the plate-shaped magnetic member units 101*a*, 101*b*, and 101*c* are laminated to form the first plate-shaped magnetic member 101. The joint portions 101$aj_5$, 101$bj_5$, and 101$cj_5$ are shifted from each other at the corner portion e of each plate-shaped magnetic member 101 in the direction of the magnetic path under the condition that the plate-shaped magnetic member units 101*a*, 101*b*, and 101*c* are laminated to form the first plate-shaped magnetic member 101. The joint portions 101$aj_6$, 101$bj_6$, and 101$cj_6$ are shifted from each other at the corner portion f of each plate-shaped magnetic member 101 in the direction of the magnetic path under the condition that the plate-shaped magnetic member units 101$a$, 101$b$, and 101$c$ are laminated to form the first plate-shaped magnetic member 101. A group of the three joint portions shifted from each other at each corner portion of the first plate-shaped magnetic member 101 is repeated at a certain interval under the condition that the first plate-shaped magnetic members 101 are laminated.

Parts that are described below and similar or the same as those shown in FIG. 4 are denoted by the same reference numerals shown in FIG. 4.

FIGS. 5A and 5B are the explanatory diagrams each showing joint portions, each of which is formed by joining together adjacent end surfaces of an adjacent pair of the magnetic member pieces and located at any of the corner portions of the first plate-shaped magnetic member 101 including the plate-shaped magnetic member units (shown in FIG. 4) laminated. FIG. 5A is a front view of the joint portions (each of which is located at any of the corner portions c, d, and f) of the adjacent end surfaces of the adjacent pairs of the magnetic member pieces 1011, 1012, 1013, 1014, and 1015. FIG. 5B is a cross sectional view of the joint portions taken along a line B-B shown in FIG. 5A.

As shown in FIGS. 5A and 5B, the joint portion 101$aj_3$ (formed by joining together the adjacent end surfaces of the adjacent magnetic member pieces 1011 and 1013 included in the plate-shaped magnetic member unit 101$a$) and the joint portion 101$bj_3$ (formed by joining together the adjacent end surfaces of the adjacent magnetic member pieces 1011 and 1015 included in the plate-shaped magnetic member unit 101$b$) are separated from each other by a distance $d_{331}$ at the corner portion c of each plate-shaped magnetic member 101. The joint portion 101$bj_3$ (formed by joining together the adjacent end surfaces of the adjacent magnetic member pieces 1011 and 1015 included in the plate-shaped magnetic member unit 101$b$) and the joint portion 101$cj_3$ (formed by joining together the adjacent end surfaces of the adjacent magnetic member pieces 1011 and 1013 included in the plate-shaped magnetic member unit 101$c$) are separated from each other by a distance $d_{332}$ at the corner portion c of each plate-shaped magnetic member 101. The joint portion 101$aj_4$ (formed by joining together the adjacent end surfaces of the adjacent magnetic member pieces 1011 and 1013 included in the plate-shaped magnetic member unit 101$a$) and the joint portion 101$bj_4$ (formed by joining together the adjacent end surfaces of the adjacent magnetic member pieces 1011 and 1015 included in the plate-shaped magnetic member unit 101$b$) are separated from each other by a distance $d_{341}$ at the corner portion d of each plate-shaped magnetic member 101. The joint portion 101$bj_4$ (formed by joining together the adjacent end surfaces of the adjacent magnetic member pieces 1011 and 1015 included in the plate-shaped magnetic member unit 101$b$) and the joint portion 101$cj_4$ (formed by joining together the adjacent end surfaces of the adjacent magnetic member pieces 1011 and 1013 included in the plate-shaped magnetic member unit 101$c$) are separated from each other by a distance $d_{342}$ at the corner portion d of each plate-shaped magnetic member 101. At each of the other corner portions a, b, e, and f of each plate-shaped magnetic member 101, the joint portions are separated from each other in the same way or in a similar way. As apparent from FIG. 5B, the group of the three joint portions shifted from each other is repeated at the certain interval by each group of the three plate-shaped magnetic member units included in the first plate-shaped magnetic member 101 under the condition that the first plate-shaped magnetic members 101 are laminated. The distances $d_{331}$, $d_{332}$, $d_{341}$, and $d_{342}$ are approximately $15\times10^{-3}$ m, for example. At each of the other corner portions a, b, e, and f of the first plate-shaped magnetic member 101, the joint portions are separated from each other by a distance of approximately $15\times10^{-3}$ m.

FIG. 6 is the explanatory diagram showing the four plate-shaped magnetic member units, each of which has one or more of the magnetic member pieces shown in FIG. 3 on each side thereof.

In FIG. 6, reference numerals 101$a$, 101$b$, 101$c$, and 101$d$ denote the respective plate-shaped magnetic member units; reference numerals 101$aj_1$ to 101$aj_4$ denote respective joint portions, each of which is formed by joining together adjacent end surfaces of an adjacent pair of the magnetic member pieces 1011 and 1015 included in the plate-shaped magnetic member unit 101$a$; reference numerals 101$aj_5$ and 101$aj_6$ denote respective joint portions, each of which is formed by joining together adjacent end surfaces of an adjacent pair of the magnetic member pieces 1014 and 1015 included in the plate-shaped magnetic member unit 101$a$; reference numerals 101$bj_1$ to 101$bj_4$ denote respective joint portions, each of which is formed by joining together adjacent end surfaces of an adjacent pair of the magnetic member pieces 1011 and 1015 included in the plate-shaped magnetic member unit 101$b$; reference numerals 101$bj_5$ and 101$bj_6$ denote respective joint portions, each of which is formed by joining together adjacent end surfaces of an adjacent pair of the magnetic member pieces 1014 and 1015 included in the plate-shaped magnetic member unit 101$b$; reference numerals 101$cj_1$ to 101$cj_4$ denote respective joint portions, each of which is formed by joining together adjacent end surfaces of an adjacent pair of the magnetic member pieces 1011 and 1013 included in the plate-shaped magnetic member unit 101$c$; reference numerals 101$cj_5$ and 101$cj_6$ denote respective joint portions, each of which is formed by joining together adjacent end surfaces of an adjacent pair of the magnetic member pieces 1012 and 1013 included in the plate-shaped magnetic member unit 101$c$; reference numerals 101$dj_1$ to 101$dj_4$ denote respective joint portions, each of which is formed by joining together adjacent end surfaces of an adjacent pair of the magnetic member pieces 1011 and 1013 included in the plate-shaped magnetic member unit 101$d$; and reference numerals 101$dj_5$ and 101$dj_6$ denote respective joint portions, each of which is formed by joining together adjacent end surfaces of an adjacent pair of the magnetic member pieces 1012 and 1013 included in the plate-shaped magnetic member unit 101$d$. The plate-shaped magnetic member unit 101$b$ has the same structure as a back structure of the plate-shaped magnetic member unit 101$a$. The plate-shaped magnetic member unit 101$d$ has the same structure as a back structure of the plate-shaped magnetic member unit 101$c$.

As shown in FIG. 7A, the joint portions 101$aj_3$, 101$bj_3$, 101$cj_3$, and 101$dj_3$ are shifted from each other at the corner portion c of the first plate-shaped magnetic member 101 in the direction of the magnetic path under the condition that the plate-shaped magnetic member units 101$a$, 101$b$, 101$c$, and 101$d$ are laminated to form the first plate-shaped magnetic member 101. In addition, the joint portions 101$aj_4$, 101$bj_4$, 101$cj_4$, and 101$dj_4$ are shifted from each other at the corner portion d of the first plate-shaped magnetic member 101 in the direction of the magnetic path under the condition that the plate-shaped magnetic member units 101$a$, 101$b$, 101$c$, and 101$d$ are laminated to form the first plate-shaped magnetic member 101. Furthermore, the joint portions 101$aj_1$, 101$bj_1$, 101$cj_1$, and 101$dj_1$ are shifted from each other at the corner portion a of the first plate-shaped magnetic member 101 in the direction of the magnetic path under the condition that the plate-shaped magnetic member units 101$a$, 101$b$, 101$c$, and 101$d$ are laminated to form the first plate-shaped magnetic member 101. The joint portions 101$aj_2$, 101$bj_2$, 101$cj_2$, and 101$dj_2$ are shifted from each other at the corner portion b of the first plate-shaped magnetic member 101 in the direction of the magnetic path under the condition that the plate-shaped magnetic member units 101$a$, 101$b$, 101$c$, and 101$d$ are laminated to form the first plate-shaped magnetic member 101. The joint portions 101$aj_5$, 101$bj_5$, 101$cj_5$, and 101$dj_5$ are shifted from each other at the corner portion e of the first plate-shaped magnetic member 101 in the direction of the magnetic path under the condition that the plate-shaped magnetic member units 101$a$, 101$b$, 101$c$, and 101$d$ are laminated to form the first plate-shaped magnetic member 101. The joint portions 101$aj_6$, 101$bj_6$, 101$cj_6$, and 101$dj_6$ are shifted from each other at the corner portion f of the first plate-shaped magnetic member 101 in the direction of the magnetic path under the condition that the plate-shaped magnetic member units 101$a$, 101$b$, 101$c$, and 101$d$ are laminated to form the first plate-shaped magnetic member 101. A group of the four joint portions shifted from each other at each corner portion is repeated at a certain interval under the condition that the first plate-shaped magnetic members 101 are laminated.

Parts that are described below and similar or the same as those shown in FIG. 6 are denoted by the same reference numerals shown in FIG. 6.

FIGS. 7A and 7B are the explanatory diagrams each showing the joint portions, each of which is formed by joining together adjacent end surfaces of an adjacent pair of the magnetic member pieces and located at any of the corner portions of the first plate-shaped magnetic member 101 including the laminated plate-shaped magnetic member units shown in FIG. 6. FIG. 7A is a front view of the joint portions (each of which is located at any of the corner portions c, d, and f), each of which is formed by joining together adjacent end surfaces of an adjacent pair of the magnetic member pieces 1011, 1012, 1013, 1014, and 1015. FIG. 7B is a cross sectional view of the joint portions taken along a line C-C shown in FIG. 7A.

As shown in FIGS. 7A and 7B, the joint portion 101$aj_3$ (formed by joining together the adjacent end surfaces of the adjacent pair of the magnetic member pieces 1011 and 1015 included in the plate-shaped magnetic member unit 101$a$) and the joint portion 101$bj_3$ (formed by joining together the adjacent end surfaces of the adjacent pair of the magnetic member pieces 1011 and 1015 included in the plate-shaped magnetic member unit 101$b$) are separated from each other by a distance $d_{431}$ at the corner portion c of the first plate-shaped magnetic member 101. The joint portion 101$bj_3$ (formed by joining together the adjacent end surfaces of the adjacent pair of the magnetic member pieces 1011 and 1015 included in the plate-shaped magnetic member unit 101$b$) and the joint portion 101$cj_3$ (formed by joining together the adjacent end surfaces of the adjacent pair of the magnetic member pieces 1011 and 1013 included in the plate-shaped magnetic member unit 101$c$) are separated from each other by a distance $d_{432}$ at the corner portion c of the first plate-shaped magnetic member 101. The joint portion 101$cj_3$ (formed by joining together the adjacent end surfaces of the adjacent pair of the magnetic member pieces 1011 and 1013 included in the plate-shaped magnetic member unit 101$c$) and the joint portion 101$dj_3$ (formed by joining together the adjacent end surfaces of the adjacent pair of the magnetic member pieces 1011 and 1013 included in the plate-shaped magnetic member unit 101$d$) are separated from each other by a distance $d_{433}$ at the corner portion c of the first plate-shaped magnetic member 101. The joint portion 101$aj_4$ (formed by joining together the adjacent end surfaces of the adjacent pair of the magnetic member pieces 1011 and 1015 included in the plate-shaped magnetic member unit 101$a$) and the joint portion 101$bj_4$ (formed by joining together the adjacent end surfaces of the adjacent pair of the magnetic member pieces 1011 and 1015 included in the plate-shaped magnetic member unit 101$b$) are separated from each other by a distance $d_{441}$ at the corner portion d of the first plate-shaped magnetic member 101. The joint portion 101$bj_4$ (formed by joining together the adjacent end surfaces of the adjacent pair of the magnetic member pieces 1011 and 1015 included in the plate-shaped magnetic member unit 101$b$) and the joint portion 101$cj_4$ (formed by joining together the adjacent end surfaces of the adjacent pair of the magnetic member pieces 1011 and 1013 included in the plate-shaped magnetic member unit 101$c$) are separated from each other by a distance $d_{442}$ at the corner portion d of the first plate-shaped magnetic member 101. The joint portion 101$cj_4$ (formed by joining together the adjacent end surfaces of the adjacent pair of the magnetic member pieces 1011 and 1013 included in the plate-shaped magnetic member unit 101$c$) and the joint portion 101$dj_4$ (formed by joining together the adjacent end surfaces of the adjacent pair of the magnetic member pieces 1011 and 1013 included in the plate-shaped magnetic member unit 101$d$) are separated from each other by a distance $d_{443}$ at the corner portion d of the first plate-shaped magnetic member 101. At each of the other corner portions a, b, e, and f of the first plate-shaped magnetic member 101, the joint portions are separated from each other in the same way or in a similar way. As apparent from FIG. 7B, the group of the four joint portions shifted from each other is repeated at the certain interval by each group of the four plate-shaped magnetic member units included in the first plate-shaped magnetic member 101 under the condition that the first plate-shaped magnetic members 101 are laminated. The distances $d_{431}$, $d_{432}$, $d_{433}$, $d_{441}$, $d_{442}$, and $d_{443}$ are approximately $10\times10^{-3}$ m, for example. At each of the other corner portions a, b, e, and f of the first plate-shaped magnetic member 101, the joint portions are separated from each other by a distance of approximately $10\times10^{-3}$ m.

FIG. 8 is the diagram showing the magnetic member pieces forming one of the second plate-shaped magnetic members 102 to 106 (that form a part of the frame type iron core included in the transformer 1 shown in FIGS. 1A and 1B).

In FIG. 8, reference numerals 1021 to 1023 denote the respective magnetic member pieces. Each of the magnetic member pieces 1021 to 1023 forms any of the sides of the second plate-shaped magnetic members 102 to 106. The magnetic member pieces 1021 to 1023 are formed by pressing respective general magnetic steel sheets having a thickness of, for example, $0.30\times10^{-3}$ m. The frame type iron core 10 includes the plurality of second plate-shaped magnetic members 102, the plurality of second plate-shaped magnetic members 103, the plurality of second plate-shaped magnetic members 104, the plurality of second plate-shaped magnetic members 105, the plurality of second plate-shaped magnetic members 106, and the plurality of first plate-shaped magnetic members 101. Specifically, the frame type iron core 10 is formed by laminating the plate-shaped magnetic members 101 to 106. Each of the second plate-shaped magnetic members 102 has the two plate-shaped magnetic member units laminated. Each of the second plate-shaped magnetic members 103 has the two plate-shaped magnetic member units laminated. Each of the second plate-shaped magnetic members 104 has the two plate-shaped magnetic member units laminated. Each of the second plate-shaped magnetic members 105 has the two plate-shaped magnetic member units laminated. Each of the second plate-shaped magnetic members 106 has the two plate-shaped magnetic member units laminated. Each of the plate-shaped magnetic member units has appropriate one or more (three or more (e.g., four)) of the magnetic member pieces 1021 to 1023 on each side thereof.

Parts that are described below and similar or the same as those shown in FIG. 8 are denoted by the same reference numerals shown in FIG. 8.

FIG. 9 is the explanatory diagram showing the two plate-shaped magnetic member units, each of which has one or more of the magnetic member pieces 1021 to 1023 shown in FIG. 8 on each side thereof. Each of the second plate-shaped magnetic members 102 to 106 includes the two plate-shaped magnetic member units.

In FIG. 9, reference numerals 102*a* and 102*b* denote the respective plate-shaped magnetic member units. The plate-shaped magnetic member units 102*a* and 102*b* form the second plate-shaped magnetic member 102. Reference numerals $\mathbf{102}aj_1$ to $\mathbf{102}aj_4$ denote respective joint portions, each of which is formed by joining together adjacent end surfaces of an adjacent pair of the magnetic member pieces 1021 and 1023 included in the plate-shaped magnetic member unit 102*a*. Reference numerals $\mathbf{102}aj_5$ and $\mathbf{102}aj_6$ denote respective joint portions, each of which is formed by joining together adjacent end surfaces of an adjacent pair of the magnetic member pieces 1022 and 1023 included in the plate-shaped magnetic member unit 102*a*. Reference numerals $\mathbf{102}bj_1$ to $\mathbf{102}bj_4$ denote respective joint portions, each of which is formed by joining together adjacent end surfaces of an adjacent pair of the magnetic member pieces 1021 and 1023 included in the plate-shaped magnetic member unit 102*b*. Reference numerals $\mathbf{102}bj_5$ and $\mathbf{102}bj_6$ denote respective joint portions, each of which is formed by joining together adjacent end surfaces of an adjacent pair of the magnetic member pieces 1022 and 1023 included in the plate-shaped magnetic member unit 102*b*.

As shown in FIG. 10A, the joint portions $\mathbf{102}aj_3$ and $\mathbf{102}bj_3$ are shifted from each other at the corner portion c of the second plate-shaped magnetic member 102 in the direction of the magnetic path under the condition that the plate-shaped magnetic member units 102*a* and 102*b* are laminated to form the second plate-shaped magnetic member 102. In addition, the joint portions $\mathbf{102}aj_4$ and $\mathbf{102}bj_4$ are shifted from each other at the corner portion d of the second plate-shaped magnetic member 102 in the direction of the magnetic path under the condition that the plate-shaped magnetic member units 102*a* and 102*b* are laminated to form the second plate-shaped magnetic member 102. Furthermore, the joint portions $\mathbf{102}aj_1$ and $\mathbf{102}bj_1$ are shifted from each other at the corner portion a of the second plate-shaped magnetic member 102 in the direction of the magnetic path under the condition that the plate-shaped magnetic member units 102*a* and 102*b* are laminated to form the second plate-shaped magnetic member 102. The joint portions $\mathbf{102}aj_2$ and $\mathbf{102}bj_2$ are shifted from each other at the corner portion b of the second plate-shaped magnetic member 102 in the direction of the magnetic path under the condition that the plate-shaped magnetic member units 102*a* and 102*b* are laminated to form the second plate-shaped magnetic member 102. The joint portions $\mathbf{102}aj_5$ and $\mathbf{102}bj_5$ are shifted from each other at the corner portion e of the second plate-shaped magnetic member 102 in the direction of the magnetic path under the condition that the plate-shaped magnetic member units 102*a* and 102*b* are laminated to form the second plate-shaped magnetic member 102. The joint portions $\mathbf{102}aj_6$ and $\mathbf{1021}bj_6$ are shifted from each other at the corner portion f of the second plate-shaped magnetic member 102 in the direction of the magnetic path under the condition that the plate-shaped magnetic member units 102*a* and 102*b* are laminated to form the second plate-shaped magnetic member 102. The pair of the joint portions shifted from each other at each corner portion is repeated at a certain interval under the condition that the second plate-shaped magnetic members 102 are laminated. Each of the second plate-shaped magnetic members 103 to 106 is configured in the same way as the second plate-shaped magnetic members 102 or in a similar way to the second plate-shaped magnetic members 102.

Parts that are described below and similar or the same as those shown in FIG. 9 are denoted by the same reference numerals shown in FIG. 9.

FIGS. 10A and 10B are the explanatory diagrams each showing the joint portions, each of which is formed by joining together adjacent end surfaces of an adjacent pair of the magnetic member pieces and located at any of the corner portions of the second plate-shaped magnetic member 102 including the laminated plate-shaped magnetic member units shown in FIG. 9. FIG. 10A is a front view of the joint portions (each of which is located at any of the corner portions c, d, and f), each of which is formed by joining together adjacent end surfaces of an adjacent pair of the magnetic member pieces 1021, 1022, and 1023. FIG. 10B is a cross sectional view of the joint portions taken along a line D-D shown in FIG. 10A.

As shown in FIGS. 10A and 10B, the joint portion $\mathbf{102}aj_3$ (formed by joining together the adjacent end surfaces of the adjacent pair of the magnetic member pieces 1021 and 1023 included in the plate-shaped magnetic member unit 102*a*) and the joint portion $\mathbf{102}bj_3$ (formed by joining together the adjacent end surfaces of the adjacent pair of the magnetic member pieces 1021 and 1023 included in the plate-shaped magnetic member unit 102*b*) are separated from each other by a distance $d_{231}$ at the corner portion c of the second plate-shaped magnetic member 102. The joint portion $\mathbf{102}aj_4$ (formed by joining together the adjacent end surfaces of the adjacent pair of the magnetic member pieces 1021 and 1023 included in the plate-shaped magnetic member unit 102*a*) and the joint portion $\mathbf{1021}bj_4$ (formed by joining together the adjacent end surfaces of the adjacent pair of the magnetic member pieces 1021 and 1023 included in the plate-shaped magnetic member unit 102*b*) are separated from each other by a distance $d_{241}$ at the corner portion d of the second plate-shaped magnetic member 102. At each of the other corner portions a, b, e, and f of the second plate-shaped magnetic member 102, the joint portions are separated from each other in the same way or in a similar way. As apparent from FIG. 10B, the pair of joint portions shifted from each other at each corner portion is repeated at the certain interval by each pair of the two plate-shaped magnetic member units included in the second plate-shaped magnetic member 102 under the condition that the second plate-shaped magnetic members 102 are laminated. The distances $d_{231}$ and $d_{241}$ are approximately $30\times10^{-3}$ m, for example. At each of the other corner portions a, b, e, and f of the second plate-shaped magnetic member 102, the joint portions are separated from each other by a distance of approximately $30\times10^{-3}$ m.

The distances by which the joint portions (each of which is formed by joining together adjacent end surfaces of an adjacent pair of the magnetic member pieces included in each first plate-shaped magnetic member 101 shown in FIGS. 5A and 5B) are separated from each other at each of the corner portions a, b, c, d, e, and f of the first plate-shaped magnetic member 101 in the direction of the magnetic path of the magnetic circuit formed by the first plate-shaped magnetic member 101 are also referred to as distances $d_{101A}$. The distances by which the joint portions (each of which is formed by joining together adjacent end surfaces of an adjacent pair of the magnetic member pieces included in each first plate-shaped magnetic member 101 shown in FIGS. 7A and 7B) are separated from each other at each of the corner portions a, b, c, d, e, and f of the first plate-shaped magnetic member 101 in the direction of the magnetic path of the magnetic circuit formed by the first plate-shaped magnetic member 101 are also referred to as distances $d_{101B}$. The distances by which the joint portions (each of which is formed by joining together adjacent end surfaces of an adjacent pair of the magnetic member pieces included in each second plate-shaped magnetic member 102 shown in FIGS. 10A and 10B) are separated from each other at each of the corner portions a, b, c, d, e, and f of the second plate-shaped magnetic member 102 in the direction of the magnetic path of the magnetic circuit formed by the second plate-shaped magnetic member 102 are also referred to as distances $d_{102}$. The distances $d_{101A}$ are larger than the distances $d_{101B}$. The distances $d_{102}$ are larger than the distances $d_{101A}$. Similarly, the distances by which the joint portions (each of which is formed by joining together adjacent end surfaces of an adjacent pair of the magnetic member pieces included in each second plate-shaped magnetic member 103) are separated from each other at each of the corner portions a, b, c, d, e, and f of the second plate-shaped magnetic member 103 in the direction of the magnetic path of the magnetic circuit formed by the second plate-shaped magnetic member 103 are also referred to as distances $d_{103}$. the distances by which the joint portions (each of which is formed by joining together adjacent end surfaces of an adjacent pair of the magnetic member pieces included in each second plate-shaped magnetic member 104) are separated from each other at each of the corner portions a, b, c, d, e, and f of the second plate-shaped magnetic member 104 in the direction of the magnetic path of the magnetic circuit formed by the second plate-shaped magnetic member 104 are also referred to as distances $d_{104}$. The distances by which the joint portions (each of which is formed by joining together adjacent end surfaces of an adjacent pair of the magnetic member pieces included in each second plate-shaped magnetic member 105) are separated from each other at each of the corner portions a, b, c, d, e, and f of the second plate-shaped magnetic member 105 in the direction of the magnetic path of the magnetic circuit formed by the second plate-shaped magnetic member 105 are also referred to as distances $d_{105}$. The distances by which the joint portions (each of which is formed by joining together adjacent end surfaces of an adjacent pair of the magnetic member pieces included in each second plate-shaped magnetic member 106) are separated from each other at each of the corner portions a, b, c, d, e, and f of the second plate-shaped magnetic member 106 in the direction of the magnetic path of the magnetic circuit formed by the second plate-shaped magnetic member 106 are also referred to as distances $d_{106}$. Each of the distances $d_{103}$ to $d_{106}$ are larger than the distances $d_{101A}$.

The three or four joint portions, each of which is formed by joining together the adjacent end surfaces of the adjacent pair of the magnetic member pieces included in each first magnetic member 101 (in which the magnetic flux is concentrated) are shifted from each other at each corner portion of the first magnetic member 101 in the direction of the magnetic path of the magnetic circuit formed by the first magnetic member 101. In addition, the frame type iron core 10 has the large thickness $t_0$. The thus-configured frame type iron core 10 can increase the effective cross sectional area of the magnetic path of the magnetic circuit formed by each first plate-shaped magnetic member 101, compared with conventional techniques. In addition, the thus-configured frame type iron core 10 can reduce the magnetic resistance of the magnetic circuit formed by each first plate-shaped magnetic member 101 and reduce an iron loss in the magnetic circuit, compared with the conventional techniques. Thus, an iron loss can be reduced in the frame type iron core 10, and a no-load loss can be reduced in the transformer 1, compared with the conventional techniques. In addition, each first plate-shaped magnetic member 101 includes the magnetic member pieces formed by pressing the high-orientation magnetic steel sheets having a high magnetic permeability. The thus-configured frame type iron core 10 can reduce the magnetic resistance of the magnetic circuit formed by each first plate-shaped magnetic member 101 and reduce an iron loss in the magnetic circuit, compared with the conventional techniques. Also, the iron loss in the frame type iron core 10 can be further reduced and the no load loss in the transformer 1 can be further reduced, compared with the conventional techniques. Since the effective cross sectional area of the magnetic path of the magnetic circuit formed by each first plate-shaped magnetic member 101 (in which the magnetic flux is concentrated) is increased, the number of the magnetic members included in the frame type iron core 10 can be reduced, compared with the conventional techniques. This suppresses an increase in the material cost of the frame type iron core 10. In addition, the thus-configured frame type iron core 10 reduces noise in the transformer 1. The present inventors have confirmed by experiment that the frame type iron core 10 can reduce the no-load loss and noise in the transformer 1, compared with the conventional techniques. The inventors experimentally produced three sample frame type iron cores A, B, and C. The sample frame type iron core A includes the plate-shaped magnetic members 101 to 106. Each of the plate-shaped magnetic members 101 to 106 included in the sample frame type iron core A includes the two plate-shaped magnetic member units shown in FIG. 9. Two joint portions, each of which is formed by joining together adjacent end surfaces of an adjacent pair of the magnetic member pieces included in each of the plate-shaped magnetic members 101 to 106 included in the sample frame type iron core A, are shifted from each other at each of the corner portions a, b, c, d, e, and f of the plate-shaped magnetic member in the direction of a magnetic path of a magnetic circuit formed by the plate-shaped magnetic member. Each of the plate-shaped magnetic members 101 to 106 included in the sample frame type iron core A has the structure shown in FIGS. 8 to 10B. The sample frame type iron core B includes the plate-shaped magnetic members 101 to 106. Each plate-shaped magnetic member 101 included in the sample frame type iron core B includes the three plate-shaped magnetic member units shown in FIG. 4. Each of the plate-shaped magnetic members 102 to 106 included in the sample frame type iron core B includes the two plate-shaped magnetic member units shown in FIG. 9. Three joint portions, each of which is formed by joining together adjacent end surfaces of an adjacent pair of the magnetic member pieces included in each plate-shaped magnetic member 101 included in the sample frame type iron core B, are shifted from each other at each of the corner portions a, b, c, d, e, and f of the plate-shaped magnetic member 101 in the direction of a magnetic path of a magnetic circuit formed by the plate-shaped magnetic member 101. A magnetic flux is concentrated in each plate-shaped magnetic member 101 included in the sample frame type iron core B. Two joint portions, each of which is formed by joining together adjacent end surfaces of an adjacent pair of the magnetic member pieces included in each of the plate-shaped magnetic members 102 to 106 included in the sample frame type iron core B, are shifted from each other at each of the corner portions a, b, c, d, e, and f of the plate-shaped magnetic member in the direction of a magnetic path of a magnetic circuit formed by the plate-shaped magnetic member. Each plate-shaped magnetic member 101 included in the sample frame type iron core B has the structure shown in FIGS. 3 to 5B. Each of the plate-shaped magnetic members 102 to 106 included in the sample frame type iron core B has the structure shown in FIGS. 8 to 10B. The sample frame type iron core C includes the plate-shaped magnetic members 101 to 106. Each plate-shaped magnetic member 101 included in the sample frame type iron core C includes the four plate-shaped magnetic member units shown in FIG. 6. Each of the plate-shaped magnetic members 102 to 106 included in the sample frame type iron core C includes two plate-shaped magnetic member units shown in FIG. 9. Four joint portions, each of which is formed by joining together adjacent end surfaces of an adjacent pair of the magnetic member pieces included in each plate-shaped magnetic member 101 included in the sample frame type iron core C, are shifted from each other at each of the corner portions a, b, c, d, e, and f of the plate-shaped magnetic member 101 in the direction of a magnetic path of a magnetic circuit formed by the plate-shaped magnetic member 101. A magnetic flux is concentrated in each plate-shaped magnetic member 101 included in the sample frame type iron core C. Two joint portions, each of which is formed by joining together adjacent end surfaces of an adjacent pair of the magnetic member pieces included in each of the plate-shaped magnetic members 102 to 106 included in the sample frame type iron core C, are shifted from each other at each of the corner portions a, b, c, d, e, and f of the plate-shaped magnetic member in the direction of a magnetic path of a magnetic circuit formed by the plate-shaped magnetic member. Each plate-shaped magnetic member 101 included in the sample frame type iron core C has the structure shown in FIGS. 3, 6, 7A, and 7B. Each of the plate-shaped magnetic members 102 to 106 included in the sample frame type iron core C has the structure shown in FIGS. 8 to 10B. The inventors conducted an experiment to measure a no-load loss in a transformer (including any of the sample frame type iron cores A to C) and noise generated during an operation of the transformer. The measured no-load loss in the transformer having the sample frame type iron core B is lower by 2.8% than the measured no-load loss in the transformer having the sample frame type iron core A. The measured no-load loss in the transformer having the sample frame type iron core C is lower by 5.0% than the measured no-load-loss in the transformer having the sample frame type iron core A. The reduction in the no-load loss in the transformer having the sample frame type iron core B, and the reduction in the no-load loss in the transformer having the sample frame type iron core C have been confirmed. The measured noise generated in the transformer having the sample frame type iron core A is 67.5 dB. The measured noise generated in the transformer having the sample frame type iron core C is 58.8 dB. The noise generated in the transformer having the sample frame type iron core C is lower by 8.7 dB than the noise generated in the transformer having the sample frame type iron core A. The reduction in the noise has been confirmed. The sample frame type iron core A has the same structure as a frame type iron core included in a conventional transformer. The sample frame type iron cores B and C have the respective structures that are the same as the frame type iron core 10 included in the transformer 1 according to the embodiment of the present invention.

The three or four joint portions, each of which is formed by joining together adjacent end surfaces of an adjacent pair of the magnetic member pieces included in each of the first plate-shaped magnetic members 101 (included in the frame type iron core 10 included in the transformer 1) are shifted from each other in the direction f the magnetic path at each of the corner portions a to f of the first plate-shaped magnetic member 101. The two joint portions, each of which is formed by joining together adjacent end surfaces of an adjacent pair of the magnetic member pieces included in each of the second plate-shaped magnetic members 102 to 106 (included in the frame type iron core 10 included in the transformer 1) are shifted from each other in the direction of the magnetic path at each of the corner portions a to f of the second plate-shaped magnetic member. Thus, the number of processes for manufacturing the frame type iron core 10 can be reduced, and workability during the processes for manufacturing the frame type iron core 10 can be improved. In order to explain the reduction in the number of the manufacturing processes and the improvement of the workability in detail, the following five cases (1) to (5) are described below. In the case (1), the frame type iron core 10 includes the plate-shaped magnetic members 101 to 106; each of the first plate-shaped magnetic members 101 includes the three plate-shaped magnetic member units; and each of the second plate-shaped magnetic members 102 to 106 includes the two plate-shaped magnetic member units. The number of types of the magnetic member pieces included in the first plate-shaped magnetic members 101 is 5 (5 types (shown in FIG. 3)×1 type of the first plate-shaped magnetic members having the same width). The number of types of the magnetic member pieces included in the second plate-shaped magnetic members 102 to 106 is 15 (3 types (shown in FIG. 8)×5 types of the second plate-shaped magnetic members 102 to 106 (the width of each magnetic member 102, the width of each magnetic member 103, the width of each magnetic member 104, the width of each magnetic member 105, and the width of each magnetic member 106 are different from each other)). The total number of the types of the magnetic member pieces included in the first and second plate-shaped magnetic members 101 to 106 is 20. The number of processes for laminating the plate-shaped magnetic member units included in the first plate-shaped magnetic members 101 is 3 (1 type of the first plate-shaped magnetic members 101×3 joint portions (each of which is formed by joining together adjacent end surfaces of an adjacent pair of the magnetic member pieces included in each first plate-shaped magnetic member 101) shifted from each other at each corner portion of the first plate-shaped magnetic member 101). The number of processes for laminating the plate-shaped magnetic member units included in the second plate-shaped magnetic members 102 to 106 is 10 (5 types of the second plate-shaped magnetic members 102 to 106×2 joint portions (each of which is formed by joining together adjacent end surfaces of an adjacent pair of the magnetic member pieces included in each second plate-shaped magnetic member) shifted from each other at each corner portion of the second plate-shaped magnetic member). Thus, the total number of the processes for laminating the plate-shaped magnetic member units included in the first and second plate-shaped magnetic members 101 to 106 is 13. Next, the case (2) is described below. In the case (2), the frame type iron core 10 includes the plate-shaped magnetic members 101 to 106; each of the first plate-shaped magnetic members 101 includes the four plate-shaped magnetic member units; and each of the second plate-shaped magnetic members 102 to 106 includes the two plate-shaped magnetic member units. The number of types of the magnetic member pieces included in the first plate-shaped magnetic members 101 is 5 (5 types (shown in FIG. 3)×1 type of the first plate-shaped magnetic members having the same width). The number of types of the magnetic member pieces included in the second plate-shaped magnetic members 102 to 106 is 15 (3 types (shown in FIG. 8)×5 types of the second plate-shaped magnetic members 102 to 106 (the width of each magnetic member 102, the width of each magnetic member 103, the width of each magnetic member 104, the width of each magnetic member 105, and the width of each magnetic member 106 are different from each other)). The total number of the types of the magnetic member pieces included in the first and second plate-shaped magnetic members 101 to 106 is 20. The number of processes for laminating the plate-shaped magnetic member units included in the first plate-shaped magnetic members 101 is 4 (1 type of the first plate-shaped magnetic members 101×4 joint portions (each of which is formed by joining together adjacent end surfaces of an adjacent pair of the magnetic member pieces included in each first plate-shaped magnetic member 101) shifted from each other at each corner portion of the first plate-shaped magnetic member 101). The number of processes for laminating the plate-shaped magnetic member units included in the second plate-shaped magnetic members 102 to 106 is 10 (5 types of the second plate-shaped magnetic members 102 to 106×2 joint portions (each of which is formed by joining together adjacent end surfaces of an adjacent pair of the magnetic member pieces included in each second plate-shaped magnetic member) shifted from each other at each corner portion of the second plate-shaped magnetic member). Thus, the total number of the processes for laminating the plate-shaped magnetic member units included in the first and second plate-shaped magnetic members 101 to 106 is 14. Next, the case (3) is described below. In the case (3), the frame type iron core 10 includes the plate-shaped magnetic members 101 to 106; and each of the first and second plate-shaped magnetic members 101 to 106 includes the two plate-shaped magnetic member units. The number of types of the magnetic member pieces included in the first and second plate-shaped magnetic members 101 to 106 is 18 (3 types (shown in FIG. 8)×6 types of the first and second plate-shaped magnetic members 101 to 106). The number of processes for laminating the plate-shaped magnetic member units included in the first and second plate-shaped magnetic members 101 to 106 is 12 (6 types of the first and second plate-shaped magnetic members 101 to 106×2 joint portions (each of which is formed by joining together adjacent end surfaces of an adjacent pair of the magnetic member pieces included in each of the plate-shaped magnetic members 101 to 106) shifted from each other at each corner portion of the plate-shaped magnetic member). Next, the case (4) describes a conventional frame type iron core. In the case (4), the conventional frame type iron core includes plate-shaped magnetic members 101 to 106; and each of the first and second plate-shaped magnetic members 101 to 106 included in the conventional iron core includes three plate-shaped magnetic member units. The number of types of magnetic member pieces included in the first and second plate-shaped magnetic members 101 to 106 included in the conventional iron core is 30 (5 types (shown in FIG. 3)×6 types of the first and second plate-shaped magnetic members 101 to 106). The number of processes for laminating the plate-shaped magnetic member units included in the first and second plate-shaped magnetic members 101 to 106 (included in the conventional iron core) is 18 (6 types of the first and second plate-shaped magnetic members 101 to 106×3 joint portions (each of which is formed by joining together adjacent end surfaces of an adjacent pair of the magnetic member pieces included in each of the plate-shaped magnetic members 101 to 106) shifted from each other at each corner portion of the plate-shaped magnetic member). Next, the case (5) describes another conventional frame type iron core. In the case (5), the conventional frame type iron core includes plate-shaped magnetic members 101 to 106; and each of the first and second plate-shaped magnetic members 101 to 106 included in the conventional iron core includes four plate-shaped magnetic member units. The number of types of magnetic member pieces included in the first and second plate-shaped magnetic members 101 to 106 included in the conventional iron core is 30 (5 types (shown in FIG. 3)×6 types of the first and second plate-shaped magnetic members 101 to 106). The number of processes for laminating the plate-shaped magnetic member units included in the first and second plate-shaped magnetic members 101 to 106 (included in the conventional iron core) is 24 (6 types of the first and second plate-shaped magnetic members 101 to 106×4 joint portions (each of which is formed by joining together adjacent end surfaces of an adjacent pair of the magnetic member pieces included in each of the plate-shaped magnetic members 101 to 106) shifted from each other at each corner portion of the plate-shaped magnetic member). The number of the types of the magnetic member pieces used in the case (1) is larger by only two than the number of the types of the magnetic member pieces used in the case (3). The number of the laminating processes performed in the case (1) is larger by only one than the number of the laminating processes performed in the case (3). However, the number of the types of the magnetic member pieces used in the case (1) is much smaller than the number of the types of the magnetic member pieces used in the case (4) and the number of the types of the magnetic member pieces used in the case (5). Also, the number of the laminating processes performed in the case (1) is much smaller than the number of the laminating processes performed in the case (4) and the number of the laminating processes performed in the case (5). The number of the types of the magnetic member pieces used in the case (2) is larger by only two than the number of the types of the magnetic member pieces used in the case (3). The number of the laminating processes performed in the case (2) is larger by only two than the number of the laminating processes performed in the case (3). However, the number of the types of the magnetic member pieces used in the case (2) is much smaller than the number of the types of the magnetic member pieces used in the case (4) and the number of the types of the magnetic member pieces used in the case (5). Also, the number of the laminating processes performed in the case (2) is much smaller than the number of the laminating processes performed in the case (4) and the number of the laminating processes performed in the case (5). Thus, the frame type iron core 10 can suppress an increase in the number of types of the magnetic member pieces and an increase in the number of the laminating processes. As a result, an increase in the number of processes for manufacturing the frame type iron core 10 can be suppressed. In addition, the workability during the processes for manufacturing the frame type iron core 10 can be improved.

The frame type iron core 10 included in the transformer according to the present invention may be configured to ensure that the plate-shaped magnetic members having the largest width and the plate-shaped magnetic members having a relatively large width have a relatively high magnetic permeability and that the plate-shaped magnetic members having the smallest width and the plate-shaped magnetic members having a relatively small width have a relatively low magnetic permeability. The frame type iron core 10 having this configuration shown in FIGS. 1A and 1B may have any of the following three structures (a) to (c). In the structure (a), the three joint portions, each of which is formed by joining together adjacent end surfaces of an adjacent pair of the magnetic member pieces included in each first plate-shaped magnetic member 101, are shifted from each other in the direction of the magnetic path at each of the corner portions a to f of the first plate-shaped magnetic member 101; the two joint portions, each of which is formed by joining together adjacent end surfaces of an adjacent pair of the magnetic member pieces included in each of the second plate-shaped magnetic members 102 to 106, are shifted from each other in the direction of the magnetic path at each of the corner portions a to f of the second plate-shaped magnetic member; each of the magnetic member pieces included in the plate-shaped magnetic members 101 and 102 is formed by pressing a high-orientation magnetic steel sheet and has a relatively high magnetic permeability; and each of the magnetic member pieces included in the plate-shaped magnetic members 103 to 106 is formed by pressing a general magnetic steel sheet and has a relatively low magnetic permeability. In the structure (b), the two joint portions, each of which is formed by joining together adjacent end surfaces of an adjacent pair of the magnetic member pieces included in each of the first and second plate-shaped magnetic members 101 to 106, are shifted from each other in the direction of the magnetic path at each of the corner portions a to f of the plate-shaped magnetic member; the magnetic member pieces included in the first plate-shaped magnetic members 101 having the largest width, and the magnetic member pieces included in the plate-shaped magnetic members (e.g., the second plate-shaped magnetic members 101 and 102) having a relatively large width, are formed by pressing respective high-orientation magnetic steel sheets and have a relatively high magnetic permeability; and the magnetic member pieces included in the second plate-shaped magnetic members 106 having the smallest width, and the plate-shaped magnetic members (e.g., the second plate-shaped magnetic members 103 to 106 having a relatively small width), are formed by pressing respective general magnetic steel sheets and have a relatively low magnetic permeability. In the structure (c), the two joint portions, each of which is formed by joining together adjacent end surfaces of an adjacent pair of the magnetic member pieces included in each of the first and second plate-shaped magnetic members 101 to 106, are shifted from each other in the direction of the magnetic path at each of the corner portions a to f of the plate-shaped magnetic member; each of the magnetic member pieces included in the first plate-shaped magnetic members 101 having the largest width is formed by pressing a high-orientation magnetic steel sheet and has a relatively high magnetic permeability; and each of the magnetic member pieces included in the second plate-shaped magnetic members 102 to 106 having a relatively small width is formed by pressing a general magnetic steel sheet and has a relatively low magnetic permeability. Each of the configurations of the frame type iron core 10 contributes to suppressing an increase in the material cost of the frame type iron core 10 and an increase in the number of the processes for manufacturing the frame type iron core 10, while characteristics of the magnetic circuit formed by the frame type iron core 10 can be improved. As a result, an iron loss can be reduced in the frame type iron core 10, and a no-load loss can be reduced in the transformer. An experiment has been conducted using samples to measure a no-load loss. The experiment has confirmed that the no-load loss can be reduced in the transformer that includes the frame type iron core 10 having any of the structures (a) to (c).

In the embodiment of the present invention, the six types of plate-shaped magnetic members are included in the frame type iron core. The widths of the plate-shaped magnetic members vary depending on the type of the plate-shaped magnetic member. The present invention, however, is not limited to this.

According to the present invention, an increase in the material cost of the frame type iron core and an increase in the number of the manufacturing processes can be suppressed, while the characteristics of the magnetic circuit formed by the frame type iron core can be improved. As a result, an iron loss can be reduced in the frame type iron core, and a no-load loss can be reduced in the transformer. In addition, noise generated during the operation of the transformer can be reduced.

Various changes and modifications can be made without departing from the spirit and scope of the present invention. The present invention, therefore, is not limited to the aforementioned embodiment. The scope of the present invention is defined in the claims. Various changes and modifications made within the meaning of an equivalent of the claims of the invention are to be regarded to be in the scope of the invention.

What is claimed is:

1. A transformer comprising:

a frame type iron core that has first and second plate-shaped magnetic members laminated in the order based on the widths of the first and second plate-shaped magnetic members, the first and second plate-shaped magnetic members forming respective annular magnetic circuits, the first plate-shaped magnetic member having the largest width in the frame type iron core, the second plate-shaped magnetic members having plural different widths in the frame type iron core, the first plate-shaped magnetic member including three or more plate-shaped magnetic member units which have one width, each of the second plate-shaped magnetic members including two-plate-shaped magnetic member units which have one width, each plate-shaped magnetic member unit of the first plate-shaped magnetic member and the second plate-shamed magnetic members having magnetic member pieces respectively that form respective sides of the plate-shaped magnetic member, each of the magnetic member pieces having end surfaces, each adjacent pair of the end surfaces of the magnetic member pieces facing each other and being joined together to form a joint portion at each of corner portions of each plate-shaped magnetic member unit, the joint portion being formed in the position which is different in a direction of the magnetic path of the magnetic circuit every plate-shaped magnetic member unit, in the first plate-shaped magnetic member, three or more joint portions being formed per one corner portion of the first plate-shaped magnetic member and being shifted from each other, in each of the second plate-shaped magnetic members two joint portions being formed per one corner portion of each of the second plate-shaped magnetic members and being shifted from each other; and a coil that is wound around the frame type iron core and excites the frame type iron core when electricity is conducted through the coil, wherein in the frame type iron core, each plate-shaped magnetic member unit of the first plate-shaped magnetic member and the second plate-shaped magnetic members has a magnetic member piece on which a concave portion having the end surface is formed.

2. The transformer according to claim 1, wherein each plate-shaped magnetic member unit of the first plate-shaped magnetic member has one or more of the magnetic member pieces on each side of the first plate-shaped magnetic member; and each plate-shaped magnetic member unit of each of the second plate-shaped magnetic members has one or more of the magnetic member pieces on each side of each of the second plate-shaped magnetic members.

3. The transformer according to claim 2, wherein each plate-shaped magnetic member unit of the first plate-shaped magnetic member has two of the magnetic member pieces on each side of the first plate-shaped magnetic member; and each plate-shaped magnetic member unit of each of the second plate-shaped magnetic members has three or more of the magnetic member pieces on each side of each of the second plate-shaped magnetic members.

4. The transformer according to claim 1, wherein the first plate-shaped magnetic member is thicker than any of the second plate-shaped magnetic members.

5. The transformer according to claim 2, wherein the first plate-shaped magnetic member is thicker than any of the second plate-shaped magnetic members.

6. The transformer according to claim 1, wherein the magnetic member pieces included in the first plate-shaped magnetic member have a higher magnetic permeability than the magnetic member pieces included in the second plate-shaped magnetic members.

7. A transformer comprising:

a frame type iron core including plate-shaped magnetic members that are laminated in the order based on the widths of the plate-shaped magnetic members and are capable of forming respective annular magnetic circuits, a first plate-shaped magnetic member having the largest width, a second plate-shaped magnetic members having a relatively large width, a relatively small width, and the smallest width, the first plate-shaped magnetic member including magnetic member pieces having a relatively high magnetic permeability, the second plate-shaped magnetic member including magnetic member pieces having a relatively high magnetic permeability, a relatively low magnetic permeability; and a coil that is wound around the frame type iron core and excites the frame type iron core when electricity is conducted through the coil, wherein the first plate-shaped magnetic member includes three or more plate-shaped magnetic member units which have one width and each of the second plate-shaped magnetic members includes two plate-shaped magnetic member unit which have one width, each plate-shaped magnetic member unit of the first magnetic member and the second plate-shaped magnetic members having magnetic member pieces that form respective sides of the plate-shaped magnetic member, each of the magnetic member pieces having end surfaces, each adjacent pair of the end, surfaces of the magnetic member pieces facing each other and being joined together to form a joint portion at each of corner portions of each plate-shaped magnetic member unit, the joint portion being formed in the position which is different in a direction of the magnetic path of the magnetic circuit every plate-shaped magnetic member unit in the first plate-shaped magnetic member three or more joint portions being formed per one corner portion of the first plate-shaped magnetic member and being shifted from each other in each of the second plate-shaped magnetic members two joint portions being formed per one corner portion of each of the second plate-shaped magnetic members and being shifted from each other, and wherein each plate-shaped magnetic member unit of the first plate-shaped magnetic member and the second plate-shaped magnetic members has a magnetic member piece on which a concave portion having the end surface is formed.

* * * * *